US007137160B2

(12) United States Patent
Hand et al.

(10) Patent No.: US 7,137,160 B2
(45) Date of Patent: Nov. 21, 2006

(54) PRONING BED

(75) Inventors: Barry D. Hand, Mt. Pleasant, SC (US); Richard Robinson, North Charleston, SC (US); Matthew R. Cavanaugh, Boxborough, MA (US); Jack J. Brooks, Folly Beach, SC (US); Vincent L. Babson, Goose Creek, SC (US); Steven J. Doehler, Charleston, SC (US); Eric Weidner, San Jose, CA (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/795,756

(22) Filed: Mar. 8, 2004

(65) Prior Publication Data

US 2004/0168253 A1 Sep. 2, 2004

Related U.S. Application Data

(63) Continuation of application No. 09/914,992, filed as application No. PCT/US00/10904 on Apr. 21, 2000, now Pat. No. 6,701,553.

(60) Provisional application No. 60/130,233, filed on Apr. 21, 1999.

(51) Int. Cl.
*A61G 7/10* (2006.01)

(52) U.S. Cl. ..... 5/607; 5/609; 5/621; 5/623; 5/624; 5/425

(58) Field of Classification Search ..... 5/607, 5/609, 621, 623, 624, 424, 425, 428
See application file for complete search history.

(56) References Cited

U.S. PATENT DOCUMENTS 516,614 A 3/1894 Seaman (Continued)

FOREIGN PATENT DOCUMENTS

EP 0025701 3/1981

(Continued)

OTHER PUBLICATIONS

RotoProne—eine Idee wird Wirklichkeit, www.kci-austria.atHTML/RotoProneDetail.htm, Jan. 8, 2004, 2 pgs.

(Continued)

*Primary Examiner*—Michael Trettel
(74) *Attorney, Agent, or Firm*—Bose McKinney & Evans LLP

(57) ABSTRACT

A bed (10) includes a base (12) and a frame assembly (14). A head end support assembly (16) and a foot end support assembly (18) are coupled between the base (12) and the frame assembly (14). The frame assembly (14) includes first and second side frame members (80, 82) located above the base (12). The bed (10) also includes a plurality of latch mechanisms (160) coupled to the first and second side frame members (80, 82), and a patient support surface (162) configured to be coupled to the first and second side frame members (80, 82) by the plurality of latch mechanisms (160). A rotational drive mechanism (130) is coupled to the foot end support assembly (18) to rotate the frame assembly (14) about its longitudinal axis to a prone position. A proning surface (250) is coupled to the frame assembly (14) to support a patient in the prone position.

29 Claims, 25 Drawing Sheets

U.S. PATENT DOCUMENTS

| | | | | |
|---|---|---|---|---|
| 795,155 | A | | 7/1905 | Nees |
| 1,021,335 | A | | 3/1912 | Robinson |
| 1,573,571 | A | | 2/1926 | Pohl |
| 1,667,982 | A | | 5/1928 | Pearson |
| 1,799,692 | A | | 4/1931 | Knott |
| 2,076,675 | A | | 4/1937 | Sharp |
| 2,141,100 | A | | 12/1938 | Warden |
| 2,239,821 | A | | 4/1941 | Knox |
| 2,311,542 | A | | 2/1943 | Holme |
| 2,391,928 | A | | 1/1946 | Seib |
| 2,417,378 | A | | 3/1947 | Robinson |
| 2,499,101 | A | | 2/1950 | Kluglein |
| 2,503,314 | A | | 4/1950 | Atwood |
| 2,607,103 | A | | 8/1952 | Davidson |
| 2,613,371 | A | | 10/1952 | Keyes, Jr. |
| 2,639,206 | A | | 5/1953 | Butler |
| 2,667,169 | A | | 1/1954 | Kambourakis |
| 2,673,987 | A | | 4/1954 | Upshaw et al. |
| 2,675,564 | A | | 4/1954 | Hughes |
| 2,715,737 | A | | 8/1955 | Sacks |
| 2,734,104 | A | | 2/1956 | Gollhofer |
| 2,803,022 | A | | 8/1957 | Wynkoop |
| 2,880,720 | A | | 4/1959 | Houghtaling |
| 2,902,701 | A | | 9/1959 | Driskill |
| 2,947,007 | A | | 8/1960 | Oades |
| 2,984,842 | A | | 5/1961 | Richards |
| 3,049,726 | A | | 8/1962 | Getz |
| 3,110,912 | A | | 11/1963 | Propst |
| 3,111,687 | A | | 11/1963 | Sacks |
| 3,151,343 | A | | 10/1964 | McCormick |
| 3,200,416 | A | | 8/1965 | Warrick |
| 3,206,188 | A | | 9/1965 | Douglass |
| 3,210,778 | A | | 10/1965 | Robinson |
| 3,226,734 | A | | 1/1966 | Coventon |
| 3,238,539 | A | | 3/1966 | Koch |
| 3,286,707 | A | | 11/1966 | Shafer |
| 3,302,218 | A | | 2/1967 | Stryker |
| 3,344,445 | A | | 10/1967 | Crawford |
| 3,388,700 | A | | 6/1968 | Mountz |
| 3,434,165 | A | * | 3/1969 | Keane ..... 5/608 |
| 3,449,776 | A | | 6/1969 | Brock |
| 3,451,070 | A | | 6/1969 | Danielson |
| 3,499,529 | A | | 3/1970 | Katzfey et al. |
| 3,514,794 | A | | 6/1970 | Pofferi |
| 3,574,871 | A | | 4/1971 | Greene |
| 3,584,321 | A | | 6/1971 | Buchanan |
| 3,609,778 | A | | 10/1971 | Zeiner |
| 3,648,305 | A | | 3/1972 | Ersek |
| 3,653,079 | A | | 4/1972 | Bourgraf et al. |
| 3,658,052 | A | | 4/1972 | Alter |
| 3,667,075 | A | | 6/1972 | Ballard et al. |
| 3,689,945 | A | | 9/1972 | Laerdal |
| 3,700,229 | A | | 10/1972 | Kurokawa et al. |
| 3,707,734 | A | | 1/1973 | Matthews |
| 3,737,924 | A | | 6/1973 | Davis |
| 3,739,406 | A | | 6/1973 | Koetter |
| 3,748,666 | A | | 7/1973 | Seng |
| 3,752,153 | A | | 8/1973 | Copeland |
| 3,765,406 | A | | 10/1973 | Toole et al. |
| 3,783,863 | A | | 1/1974 | Kliever |
| 3,814,414 | A | | 6/1974 | Chapa |
| 3,820,176 | A | | 6/1974 | Feiertag |
| 3,827,089 | A | | 8/1974 | Grow |
| 3,828,377 | A | | 8/1974 | Eary, Sr. |
| 3,832,742 | A | | 9/1974 | Stryker |
| 3,840,221 | A | | 10/1974 | Hogan |
| 3,851,644 | A | | 12/1974 | Slagle |
| 3,868,103 | A | | 2/1975 | Pageot et al. |
| 3,874,010 | A | | 4/1975 | Geary |
| 3,884,225 | A | | 5/1975 | Witter |
| 3,890,659 | A | | 6/1975 | Staubs |
| 3,902,204 | A | | 9/1975 | Lee |
| 3,905,591 | A | * | 9/1975 | Schorr et al. ..... 5/601 |
| 3,926,181 | A | | 12/1975 | Eischen |
| 3,940,808 | A | | 3/1976 | Petrini |
| 3,941,365 | A | | 3/1976 | Frymoyer |
| 4,017,737 | A | | 4/1977 | Hudson et al. |
| 4,024,861 | A | | 5/1977 | Vincent |
| 4,030,719 | A | | 6/1977 | Gabriele et al. |
| 4,033,000 | A | | 7/1977 | Bonifay |
| 4,054,960 | A | | 10/1977 | Pettit et al. |
| 4,071,916 | A | | 2/1978 | Nelson |
| 4,080,673 | A | | 3/1978 | Weisler |
| 4,084,274 | A | | 4/1978 | Willis et al. |
| 4,109,329 | A | | 8/1978 | Tupper |
| 4,152,795 | A | | 5/1979 | Rodosta et al. |
| 4,156,815 | A | | 5/1979 | Hogan |
| 4,175,550 | A | | 11/1979 | Leininger et al. |
| 4,183,110 | A | | 1/1980 | Kidd et al. |
| 4,194,732 | A | | 3/1980 | Liebman |
| 4,195,829 | A | | 4/1980 | Reser |
| 4,231,030 | A | | 10/1980 | Weiss |
| 4,244,358 | A | | 1/1981 | Pyers |
| 4,252,594 | A | | 2/1981 | Cooper |
| 4,259,950 | A | | 4/1981 | Klippel |
| 4,274,167 | A | | 6/1981 | Immel |
| 4,277,857 | A | | 7/1981 | Svehaug |
| 4,301,791 | A | | 11/1981 | Franco, III |
| 4,347,635 | A | | 9/1982 | Eisenhauer |
| 4,356,577 | A | | 11/1982 | Taylor et al. |
| 4,369,982 | A | | 1/1983 | Hein et al. |
| 4,384,378 | A | | 5/1983 | Getz et al. |
| 4,395,786 | A | | 8/1983 | Casey et al. |
| 4,432,353 | A | | 2/1984 | Vrzalik |
| 4,473,912 | A | | 10/1984 | Scheidel et al. |
| 4,480,345 | A | | 11/1984 | Dunn |
| 4,490,867 | A | | 1/1985 | Gabrielsson |
| 4,506,664 | A | | 3/1985 | Brault |
| 4,533,726 | A | | 8/1985 | Myers |
| 4,535,762 | A | | 8/1985 | Natchev |
| 4,557,471 | A | | 12/1985 | Pazzini |
| 4,558,857 | A | | 12/1985 | Heller |
| 4,566,445 | A | | 1/1986 | Jelsma et al. |
| 4,572,493 | A | | 2/1986 | Hubert |
| 4,578,833 | A | | 4/1986 | Vrzalik |
| 4,579,111 | A | | 4/1986 | Ledesma |
| 4,584,729 | A | | 4/1986 | Roberts et al. |
| 4,584,989 | A | | 4/1986 | Stith |
| 4,586,492 | A | | 5/1986 | Manahan |
| 4,593,264 | A | | 6/1986 | Engle |
| 4,596,384 | A | | 6/1986 | Blosser |
| 4,601,075 | A | | 7/1986 | Smith |
| 4,612,678 | A | | 9/1986 | Fitsch |
| 4,619,270 | A | | 10/1986 | Margolis et al. |
| 4,638,516 | A | | 1/1987 | Vrzalik |
| 4,655,206 | A | | 4/1987 | Moody |
| 4,658,450 | A | | 4/1987 | Thompson |
| 4,660,236 | A | | 4/1987 | Peterson |
| 4,685,159 | A | | 8/1987 | Oetiker |
| 4,763,643 | A | | 8/1988 | Vrzalik |
| 4,769,584 | A | | 9/1988 | Irigoyen et al. |
| 4,779,858 | A | | 10/1988 | Saussereau |
| 4,811,435 | A | | 3/1989 | Foster et al. |
| 4,827,541 | A | | 5/1989 | Vollman et al. |
| 4,840,362 | A | | 6/1989 | Bremer et al. |
| 4,841,585 | A | | 6/1989 | Masuzawa |
| 4,847,929 | A | | 7/1989 | Pupovic |
| 4,852,193 | A | | 8/1989 | Alsip et al. |
| 4,856,128 | A | | 8/1989 | Alsip et al. |
| 4,866,796 | A | | 9/1989 | Robinson et al. |
| 4,868,937 | A | | 9/1989 | Connolly |
| 4,872,657 | A | | 10/1989 | Lussi |
| 4,873,710 | A | | 10/1989 | Lotman |
| 4,873,731 | A | | 10/1989 | Williamson |

| | | | | |
|---|---|---|---|---|
| 4,895,173 | A | | 1/1990 | Brault et al. |
| 4,912,754 | A | | 3/1990 | Van Steenburg |
| 4,920,589 | A | * | 5/1990 | LaVelle et al. ..... 5/607 |
| 4,924,537 | A | | 5/1990 | Alsip et al. |
| 4,939,801 | A | | 7/1990 | Schaal et al. |
| 4,941,221 | A | | 7/1990 | Kanzler |
| 4,944,054 | A | | 7/1990 | Bossert |
| 4,947,418 | A | | 8/1990 | Barr et al. |
| 4,947,496 | A | * | 8/1990 | Connolly ..... 5/607 |
| 4,951,032 | A | | 8/1990 | Langsam |
| 4,958,817 | A | | 9/1990 | Heller et al. |
| 4,960,271 | A | | 10/1990 | Sebring |
| 4,970,739 | A | | 11/1990 | Bradford |
| 4,987,622 | A | | 1/1991 | Shockey |
| 4,988,062 | A | | 1/1991 | London |
| 5,005,233 | A | | 4/1991 | Toivio et al. |
| 5,014,374 | A | | 5/1991 | Williams |
| 5,016,268 | A | | 5/1991 | Lotman |
| 5,018,712 | A | | 5/1991 | Schaefer |
| 5,020,170 | A | | 6/1991 | Ruf |
| 5,023,968 | A | | 6/1991 | Diehl et al. |
| 5,048,071 | A | | 9/1991 | Van Steenburg |
| 5,048,134 | A | | 9/1991 | Dennill et al. |
| 5,060,324 | A | | 10/1991 | Marinberg et al. |
| 5,062,171 | A | | 11/1991 | Vrzalik |
| 5,073,999 | A | | 12/1991 | Thomas et al. |
| 5,083,574 | A | | 1/1992 | Schlutow |
| 5,088,137 | A | | 2/1992 | Rose |
| 5,088,706 | A | | 2/1992 | Jackson |
| 5,092,007 | A | | 3/1992 | Hasty |
| 5,103,511 | A | | 4/1992 | Sequin |
| 5,121,514 | A | | 6/1992 | Rosane |
| 5,121,756 | A | | 6/1992 | Koledin |
| 5,127,422 | A | | 7/1992 | Colon |
| 5,131,103 | A | | 7/1992 | Thomas et al. |
| 5,131,105 | A | | 7/1992 | Harrawood et al. |
| 5,131,106 | A | | 7/1992 | Jackson |
| 5,148,815 | A | | 9/1992 | Britton |
| 5,152,024 | A | | 10/1992 | Chrones et al. |
| 5,154,185 | A | | 10/1992 | Latimer et al. |
| 5,154,186 | A | | 10/1992 | Laurin et al. |
| 5,159,312 | A | | 10/1992 | Engle |
| 5,179,746 | A | | 1/1993 | Rogers |
| 5,181,288 | A | | 1/1993 | Heaton et al. |
| 5,190,056 | A | | 3/1993 | Hull |
| 5,208,928 | A | | 5/1993 | Kuck et al. |
| 5,211,186 | A | | 5/1993 | Shoemaker et al. |
| 5,230,112 | A | | 7/1993 | Harrawood et al. |
| 5,230,113 | A | | 7/1993 | Foster et al. |
| 5,243,639 | A | | 9/1993 | Johnson |
| 5,249,318 | A | | 10/1993 | Loadsman |
| 5,250,802 | A | | 10/1993 | Runner |
| 5,255,303 | A | | 10/1993 | DiMaio et al. |
| 5,263,213 | A | | 11/1993 | Robertson et al. |
| 5,274,862 | A | | 1/1994 | Palmer, Jr. et al. |
| 5,274,864 | A | | 1/1994 | Morgan |
| 5,285,797 | A | | 2/1994 | Zeller |
| 5,299,334 | A | | 4/1994 | Gonzalez |
| 5,319,817 | A | | 6/1994 | Hay et al. |
| 5,334,186 | A | | 8/1994 | Alexander |
| 5,336,179 | A | | 8/1994 | Ryan |
| 5,345,630 | A | | 9/1994 | Healy |
| 5,396,673 | A | | 3/1995 | Foster |
| 5,398,356 | A | | 3/1995 | Pfleger |
| 5,404,603 | A | | 4/1995 | Fukai et al. |
| 5,412,823 | A | | 5/1995 | Sitta |
| 5,414,883 | A | | 5/1995 | Fangrow, Jr. |
| 5,418,990 | A | | 5/1995 | Risasen |
| 5,425,148 | A | | 6/1995 | Ashcraft et al. |
| 5,427,338 | A | | 6/1995 | Garrett et al. |
| 5,433,741 | A | | 7/1995 | Truglio |
| 5,435,323 | A | | 7/1995 | Rudy |
| 5,473,784 | A | | 12/1995 | Nixon et al. |
| 5,481,770 | A | | 1/1996 | Ahlsten |
| 5,494,051 | A | | 2/1996 | Schneider, Sr. |
| 5,497,097 | A | | 3/1996 | Walling et al. |
| 5,499,416 | A | | 3/1996 | Daouk |
| 5,502,853 | A | | 4/1996 | Singleton et al. |
| 5,502,854 | A | | 4/1996 | Daouk |
| 5,515,561 | A | | 5/1996 | Suggitt et al. |
| 5,515,869 | A | | 5/1996 | Powell et al. |
| 5,530,974 | A | | 7/1996 | Rains et al. |
| 5,560,059 | A | | 10/1996 | McQueen |
| 5,568,662 | A | | 10/1996 | Gougelet |
| 5,575,027 | A | * | 11/1996 | Mueller ..... 5/621 |
| 5,577,281 | A | | 11/1996 | Mital et al. |
| 5,611,096 | A | | 3/1997 | Bartlett et al. |
| 5,621,932 | A | | 4/1997 | Strachan |
| 5,621,933 | A | | 4/1997 | Knapp et al. |
| 5,625,913 | A | | 5/1997 | Singleton |
| 5,626,150 | A | | 5/1997 | Johnson et al. |
| 5,664,270 | A | | 9/1997 | Bell et al. |
| 5,699,568 | A | | 12/1997 | Couldridge |
| 5,740,571 | A | | 4/1998 | Tyra |
| 5,769,797 | A | | 6/1998 | Van Brunt et al. |
| 5,790,996 | A | | 8/1998 | Narfstrom |
| 5,860,899 | A | | 1/1999 | Rassman |
| 5,864,901 | A | | 2/1999 | Blumel |
| 5,966,762 | A | | 10/1999 | Wu |
| 6,012,183 | A | | 1/2000 | Brooke et al. |
| 6,021,533 | A | | 2/2000 | Ellis et al. |
| 6,030,353 | A | | 2/2000 | Van Brunt |
| 6,036,662 | A | | 3/2000 | Van Brunt et al. |
| 6,065,165 | A | | 5/2000 | Delk et al. |
| 6,108,838 | A | | 8/2000 | Connolly et al. |
| 6,112,349 | A | | 9/2000 | Connolly |
| 6,119,292 | A | | 9/2000 | Haas |
| 6,141,806 | A | | 11/2000 | Bobey et al. |
| 6,155,996 | A | | 12/2000 | Van Brunt et al. |
| 6,240,584 | B1 | | 6/2001 | Perez et al. |
| 6,260,220 | B1 | | 7/2001 | Lamb et al. |
| 6,282,736 | B1 | | 9/2001 | Hand et al. |
| 6,308,353 | B1 | | 10/2001 | Van Steenburg |
| 6,327,727 | B1 | | 12/2001 | Bocharnikov |
| 6,340,025 | B1 | | 1/2002 | Van Brunt |
| 6,353,949 | B1 | | 3/2002 | Falbo |
| 6,375,017 | B1 | | 4/2002 | Schattner et al. |
| 6,379,316 | B1 | | 4/2002 | Van Brunt et al. |
| 6,385,801 | B1 | | 5/2002 | Watanabe et al. |
| 6,415,791 | B1 | | 7/2002 | Van Brunt |
| 6,471,663 | B1 | | 10/2002 | Van Brunt et al. |
| 6,499,160 | B1 | | 12/2002 | Hand et al. |
| 6,526,610 | B1 | | 3/2003 | Hand et al. |
| 6,609,260 | B1 | | 8/2003 | Hand et al. |
| 6,662,391 | B1 | | 12/2003 | Wilson et al. |
| 6,691,347 | B1 | | 2/2004 | Hand et al. |
| 6,701,553 | B1 | | 3/2004 | Hand et al. |
| 2002/0026671 | A1 | | 3/2002 | Hand et al. |
| 2003/0126683 | A1 | | 7/2003 | Hand et al. |

FOREIGN PATENT DOCUMENTS

| | | |
|---|---|---|
| EP | 0 569 308 A1 | 11/1993 |
| EP | 0 641 545 A1 | 9/1994 |
| FR | 2.034.679 | 12/1970 |
| FR | 2 247 194 | 5/1975 |
| FR | 2 549 366 | 1/1985 |
| FR | 2 585 240 | 1/1987 |
| FR | 2 587 898 | 4/1987 |
| FR | 2 749 503 | 12/1997 |
| GB | 2 182 570 | 5/1987 |
| TW | 77886 | 11/1975 |
| WO | WO 93/05745 | 9/1992 |
| WO | WO 97/22323 | 6/1997 |
| WO | WO 98/39996 | 9/1998 |
| WO | WO 99/07320 | 2/1999 |

| | | |
|---|---|---|
| WO | WO 99/53997 | 10/1999 |
| WO | WO 99/62454 | 12/1999 |
| WO | WO 00/00117 | 1/2000 |
| WO | WO 01/62151 | 8/2001 |
| WO | WO 01/70164 | 9/2001 |
| WO | WO 02/05740 | 1/2002 |

OTHER PUBLICATIONS

KCI Austria (KCI-Mediscus) Kinetishce Therapiesysteme, "Intensivetherapie", www.kci-austria.at/HTML/Intensivetherapie.htm, Jan. 8, 2004, 3 pgs.

* cited by examiner

PRONING BED

CROSS-REFERENCE TO RELATED APPLICATIONS

This application is a continuation of U.S. patent application Ser. No. 09/914,992, filed Sep. 6, 2001, now U.S. Pat. No. 6,701,553 which is the national phase under 35 S.C. § 371 of PCT International Application No. PCT/US00/10904, having an International Filing date of Apr. 21, 2000, which claims the benefit of U.S. Provisional Application Ser. No. 60/130,233, filed Apr. 21, 1999, the disclosures of which are all expressly incorporated by reference herein.

BACKGROUND AND SUMMARY OF THE INVENTION

The present invention relates to a proning bed which permits rotation of a patient supported on a patient support surface of the bed.

A bed of the present invention illustratively includes a base, and a support assembly coupled to the base. The support assembly includes first and second spaced apart side frame members located above the base. The apparatus also includes a plurality of latch mechanisms coupled to the first and second side frame members, and a patient support surface configured to be coupled to the first and second side frame members by the plurality of latch mechanisms. The patient support surface is removable from the first and second support arms to permit transfer of a patient to and from the bed on the patient support surface. In an illustrated embodiment, the support assembly includes a rotatable drive mechanism coupled to the first and second side frame members for rotating the first and second side frame members about a longitudinal axis.

A proning surface is configured to be coupled to the first and second side frame members. The proning surface is configured to support the patient in a prone position when the patient support assembly is rotated 180° about its longitudinal axis by the drive mechanism.

The illustrated patient support surface includes an outer frame configured to be coupled to the plurality of latch mechanisms to secure the patient support surface to the first and second side frame members. The patient support surface also includes a plurality of panels coupled to the outer frame.

The illustrated embodiment of the present invention includes a transfer surface coupled to the base. The transfer surface is movable from a lowered position to an elevated position located adjacent the first and second support arms when the patient support surface is coupled to and removed from the first and second side frame members. In one embodiment, the transfer surface is configured to engage a portion of the plurality of latch mechanisms as the transfer surface is moved to the elevated position to open the latch mechanisms for receiving the patient support surface.

Additional features of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying drawings in which.

DETAILED DESCRIPTION OF THE DRAWINGS

Figure 1:
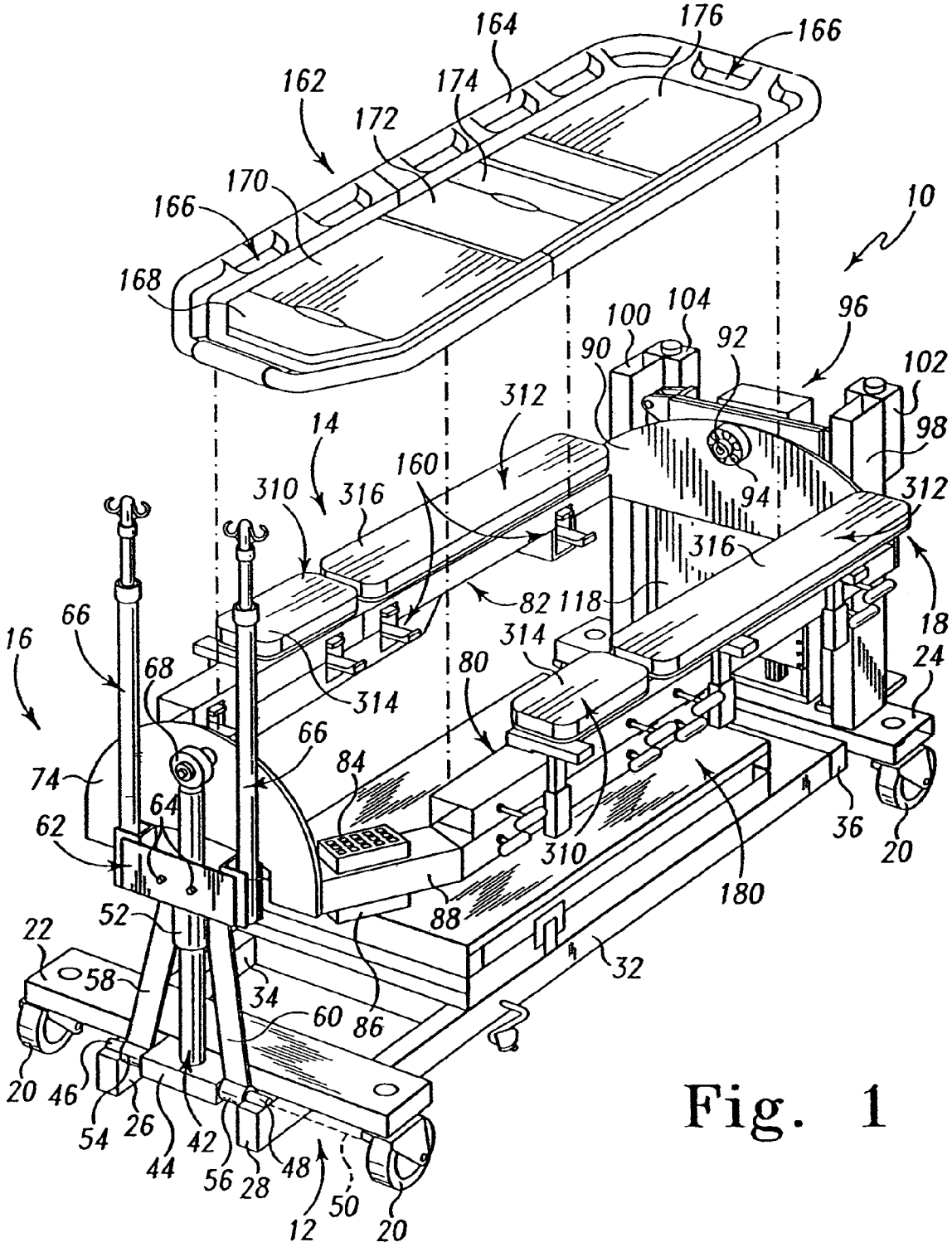
FIG. 1 is an exploded perspective view of a proning bed of the present invention including a patient support surface spaced apart from first and second side frame members which are coupled to a support assembly for rotating the frame members.
Figure 2:
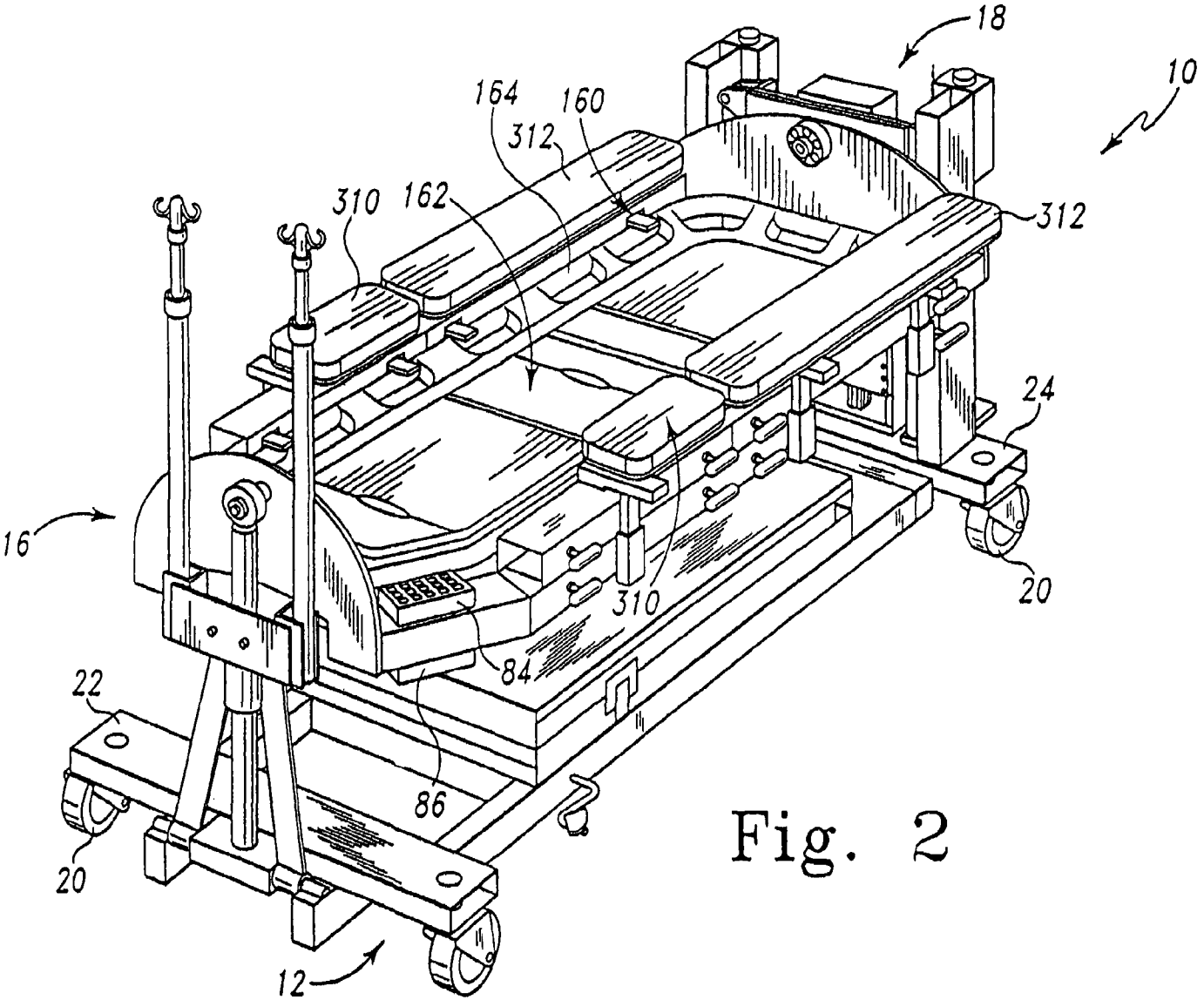
FIG. 2 is a perspective view similar to FIG. 1 in which the patient support surface has been coupled to the first and second side frame members.
Figure 3:
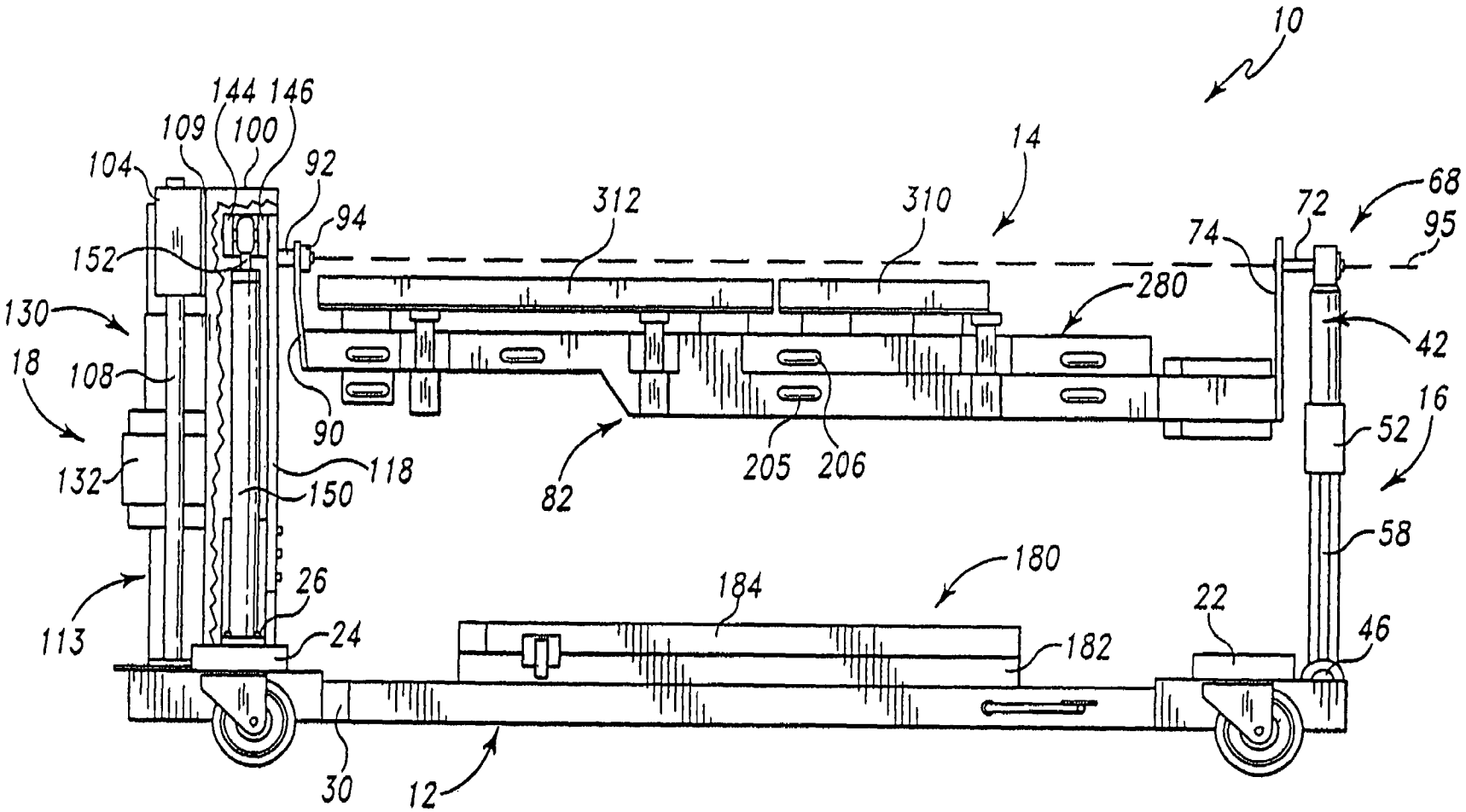
FIG. 3 is a side elevational view of the bed of FIGS. 1 and 2, with portions broken away to illustrate a lifting mechanism located at a foot end of the bed.
Figure 10:
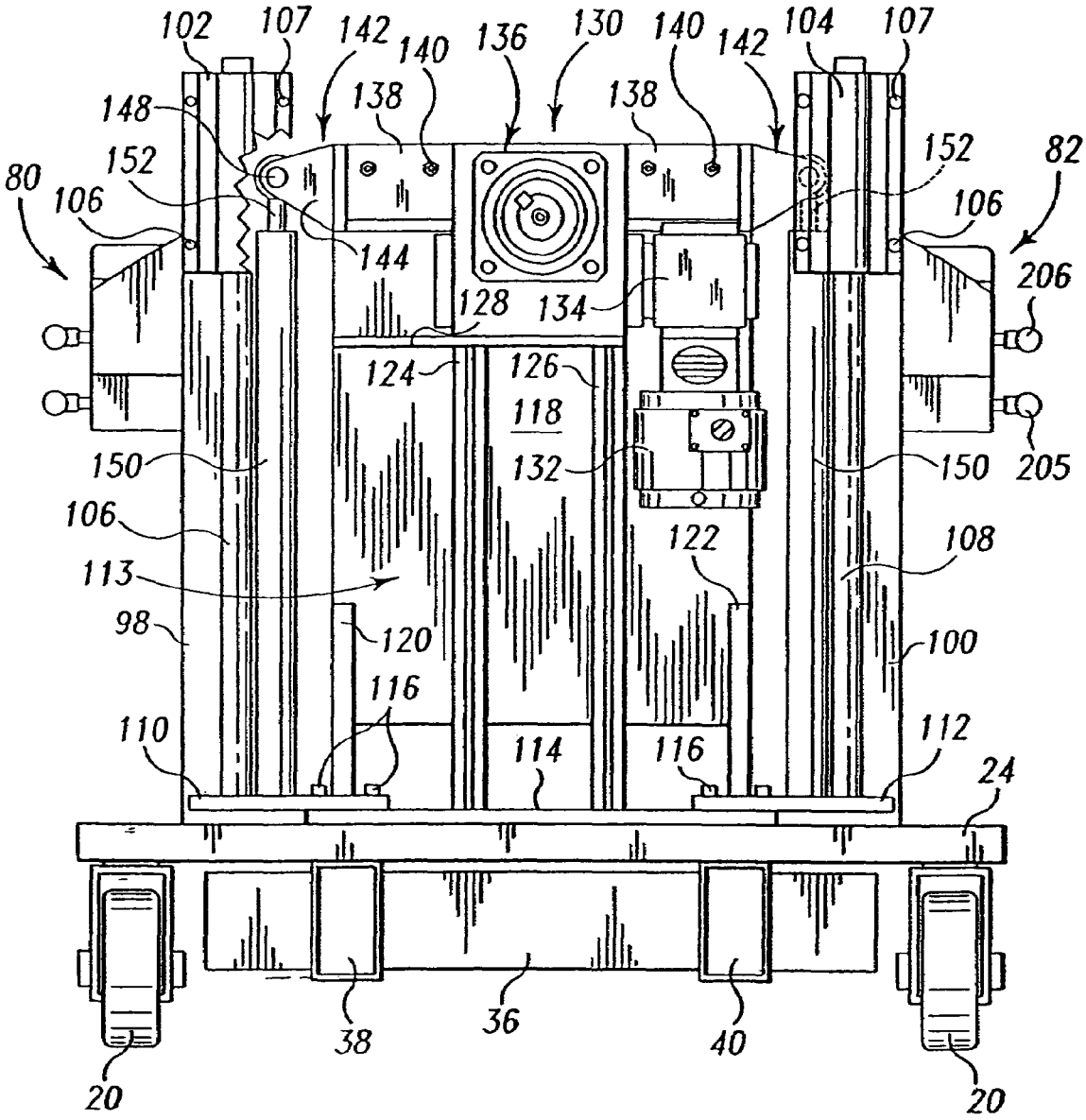
FIG. 10 is an end elevational view, with portions broken away, illustrating a foot end support assembly which includes a rotational drive mechanism for rotating the first and second side frame members and the patient support about a longitudinal axis.

Referring now to the drawings, FIG. 1 illustrates a bed 10 having a base 12 and a frame assembly 14 coupled to the base by a head end support assembly 16 and a foot end support assembly 18. Base 12 is supported by casters 20. Base 12 includes cross members 22 and 24 located at opposite ends of the base 12. Inner base members 26 and 28 are coupled to cross member 22 at a head end of bed 10. A transverse base member 30 shown in FIG. 3 is connected to inner base members 26 and 28. Opposite side base members 32 and 34 are coupled to base member 30. Transverse base member 36 is coupled to members 32 and 34 adjacent cross member 24. Inner base members 38 and 40 are coupled to transverse base member 36 and to cross member 24 as best shown in FIG. 10.

Head end support assembly 16 includes a hydraulic cylinder 42 mounted on a support 44. A hydraulic fluid supply line (not shown) is coupled to support 44 to control flow of hydraulic fluid into and out of the cylinder 42. Support 44 is coupled to first and second axles 46 and 48 which rotatably couple the support 44 to the inner frame members 26 and 28, respectively. Therefore, the head end support assembly 16 is pivotable about transverse axis 50. Head end support assembly 16 further includes a sleeve 52 surrounding cylinder 48 and first and second lower sleeves 54 and 56 located around axles 46 and 48, respectively. Struts 58 and 60 are configured to couple sleeves 54 and 56, respectively, to sleeve 52. A support bracket 62 is illustratively coupled to the cylinder 42 or sleeve 52 by suitable fasteners 64. Bracket 62 is configured to receive IV poles 66 or other equipment. The IV poles 66 or other equipment are illustratively secured to bracket 62 by suitable fasteners, clamps or sockets.

Figure 4:
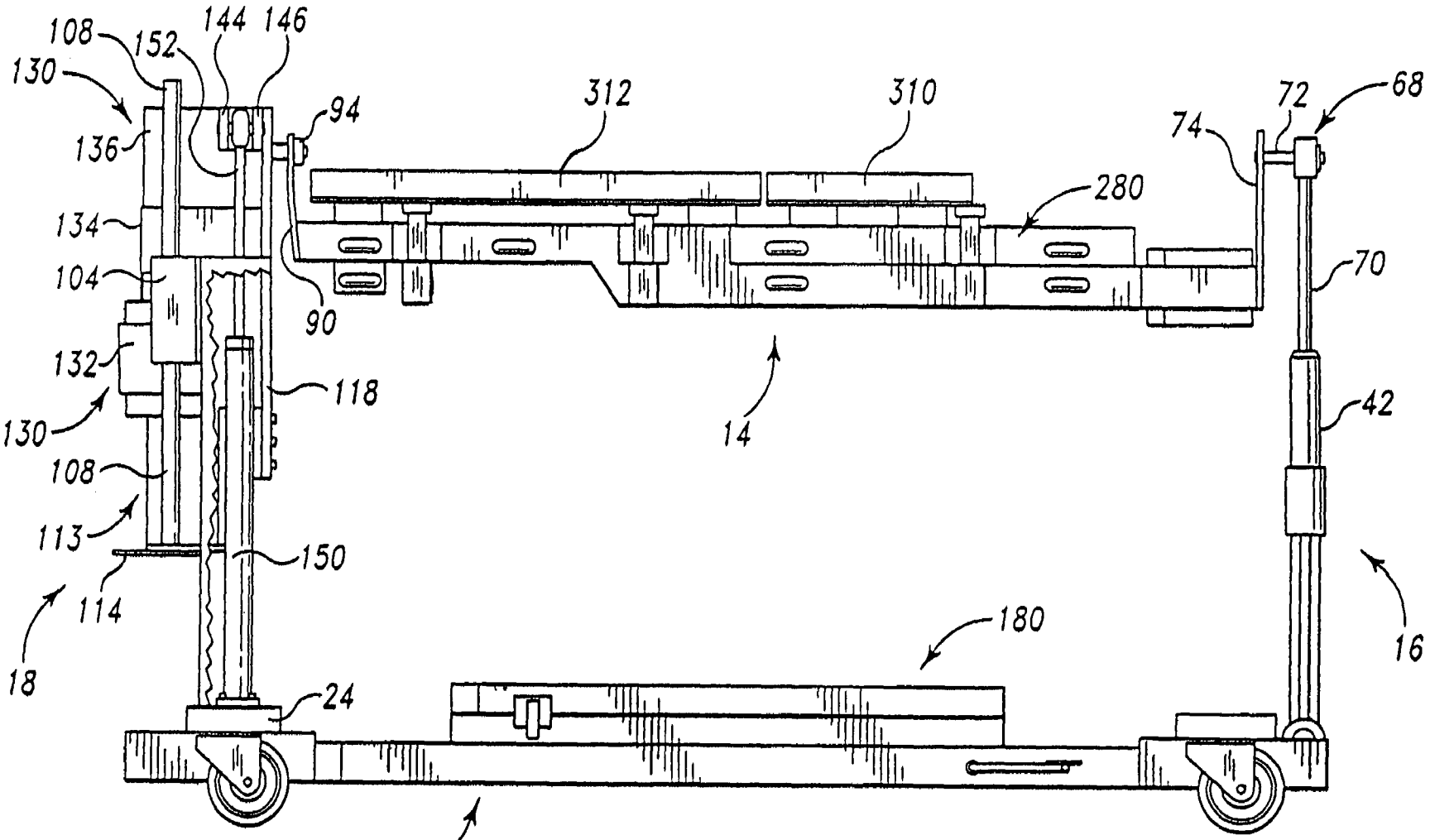
FIG. 4 is a side elevational view similar to FIG. 3 in which the first and second side frame members and the patient support surface have been moved to an elevated position by the lifting mechanism located at the foot end of the bed and by a second lifting mechanism located at the head end of the bed.

A universal joint 68 is coupled to a piston 70 located within hydraulic cylinder 42 as best shown in FIG. 4. Universal joint 68 includes a rotating shaft 72 which is rigidly coupled to a head end plate 74. Therefore, plate 74 and shaft 72 rotate relative to the remainder of universal joint 68 when the frame assembly 14 is rotated as discussed below.

Figure 23:
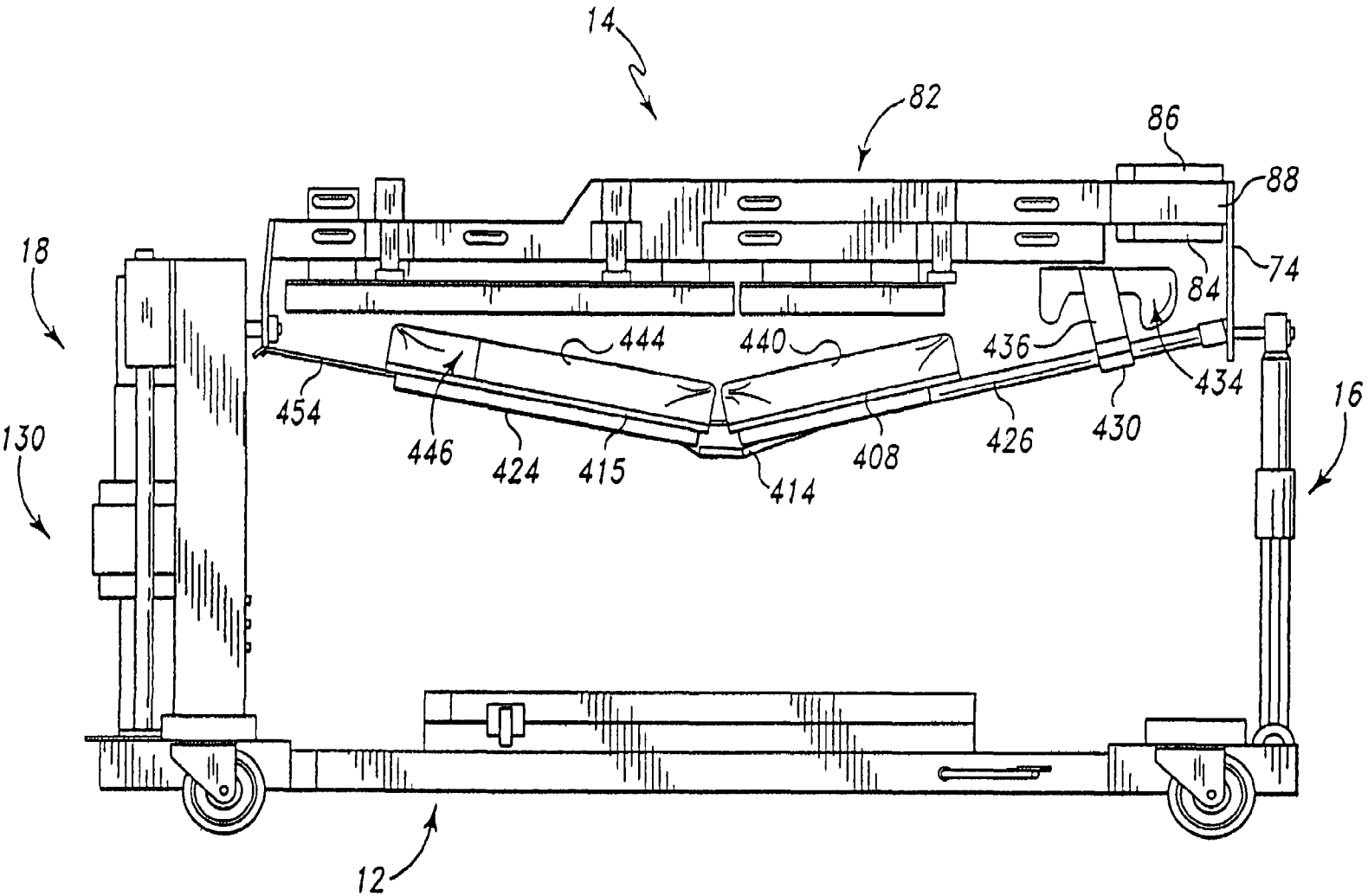
FIG. 23 is a side elevational view illustrating the head and foot end supports and the proning surface rotated 180° in order to prone a patient located on the proning surface.

First and second side frame members 80 and 82 are coupled to plate 74. Top and bottom control panels 84 and 86 mounted in top and bottom surfaces, respectively, on angled sections 88 of the first and second side frame members 80 and 82. Top display 84 provides controls for bed functions on the bed 10 when the frame assembly 14 is in the position shown in FIGS. 1–5 for supporting the patient in a supine position. When the frame assembly 14 is rotated 180° to prone the patient as shown in FIG. 23, the bottom control panel 86 is readily accessible to the caregiver at the head end of the bed 10. Therefore, the present invention provides dual control panels on each frame member 80 and 82. The first control panel 84 is configured for actuation in the supine position. and the second control panel 86 is configured for actuation by caregiver when the patient is in a prone position.

Opposite ends of the first and second side frame members 80 and 82 are coupled to a foot end plate 90. Foot end plate 90 is connected to a shaft 92 by a coupler 94. The rotational drive mechanism 96, discussed below, is configured to rotate shaft 92 which, in turn, rotates the frame assembly 14 about its longitudinal axis 94 illustrated in FIG. 3. The frame assembly 14 may be rotated a full 360° about axis 95.

Foot end support assembly 18 includes spaced apart vertical support posts 98 and 100. Guide sleeves 102 and 104 are rigidly mounted to plates 109 by suitable fasteners 107. Plates 109 are welded to the top portions of each of the support posts 98 and 100. In other words, sleeves 102 and 104 are rigidly mounted to posts 98 and 100 and do not move relative to base 12. Sleeves 102 and 104 are configured to slidably receive guide rods 106 and 108, respectively. Guide rods 106 and 108 are rigidly coupled to first and second plates 110 and 112, respectively, of support platform 113. Plates 110 and 112 are coupled to bottom support plate 114 by suitable fasteners 116.

Bottom plate 114 is coupled to a vertical plate 118 by side support plates 120 and 122. Vertical support posts 124 and 126 also extend upwardly from bottom plate 114. Support posts 124 and 126 are configured to support a plate 128 of support platform 113. Plate 128 supports a rotational drive mechanism 130 which illustratively includes a drive motor 132, a gear mechanism 134, and a coupling mechanism 136. Coupling mechanism 136 is a gear mechanism and may include a clutch mechanism which selectively engages and disengages from the shaft 92.

A pair of mounting plates 138 are coupled to vertical plate 118 by suitable fasteners 140. Mounting plates 138 each include a clevis 142 having spaced apart arms 144 and 146.

Arms 144 and 146 are each formed to include an aperture for receiving a pin 148. A pair of spaced apart lifting cylinders 150 are coupled to cross frame member 24 by suitable fasteners 26 as shown in FIG. 3. Each cylinder includes a movable piston 152. A head 154 of piston 152 is coupled to the arms 144 and 146 of clevis 142 by the pin 148. When cylinders 150 are actuated by hydraulic fluid, for example, the pistons 152 are extended upwardly to the position shown in FIG. 4. Extension of pistons 152 causes vertical plate 118 and bottom plate 114 of support platform 113 to move upwardly. The guide rods 106 and 108 and rotational drive mechanism 130 also move upwardly. Therefore, the frame assembly 14 can be rotated when the frame assembly 14 is either in its elevated position shown in FIG. 4 or in its lower position as shown in FIG. 3.

To move the patient support surface to its elevated position, pistons 152 of cylinders 150 and piston 70 of cylinder 42 are each extended to the position shown in FIG. 4. In order to move the bed to a Trendelenburg or reverse Trendelenburg position, the pistons 152 and piston 70 are separately extended. In the Trendelenburg position and the reverse Trendelenburg positions, the head support assembly 16 pivots about axis 50. Coupler 94 also permits limited movement to achieve the Trendelenburg and the reverse Trendelenburg positions. It is understood that other types of lifting mechanisms may be used in place of cylinders 42 and 150 including, for example, gear drives, scissors lift mechanisms, cables or other suitable structures.

The first and second side frame members 80 and 82 are coupled between the head end plate 74 and the foot end plate 90. A plurality of latch mechanisms 160 are coupled to both the first and second side frame members 80 and 82. As discussed in detail below, the latch mechanisms 160 are configured to secure the patient support surface 162 to the first and second side frame members 80 and 82. Illustratively, patient support surface 162 includes an outer frame 164 defining a plurality of grip handle portions 166. A plurality of pivotable panels 168, 170, 172, 174, and 176 are coupled to the outer frame 164. These panels 168, 170, 172, 174, and 176 are selectively pivotable relative to the outer frame 164. Details of another suitable patient support are disclosed in PCT International Publication No. WO 00/00152 which is incorporated herein by reference. This pivotable movement of panels 168, 170, 172, 174 and 176 provides access to the patient when in a prone position.

Figure 22:
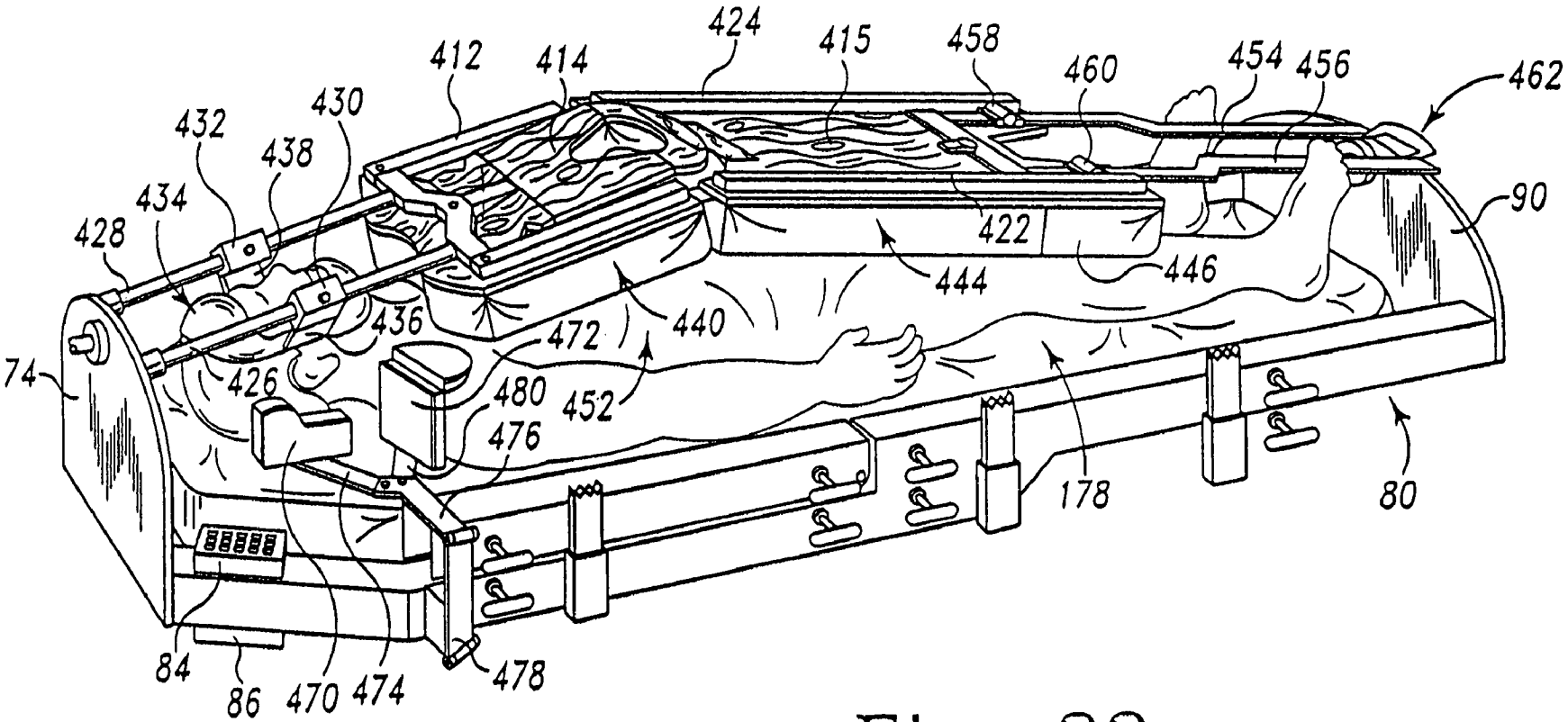
FIG. 22 illustrates the proning surface of FIGS. 20 and 21 mounted to head and foot end supports over a patient located on the patient support surface.

Illustratively, a mattress 178 shown in FIG. 22 is located over the patient support surface 162. The mattress 178 illustratively includes any suitable support material such as air, foam, springs, fluid, beads, gel, etc. Patient support surface 162 is illustratively designed for use in the field at an injury location, for example, for transporting a patient in the manner of a backboard or a stretcher. The support surface 162 is then loaded in to the bed 10 without having to move the patient off the support surface 162.

Figure 5:
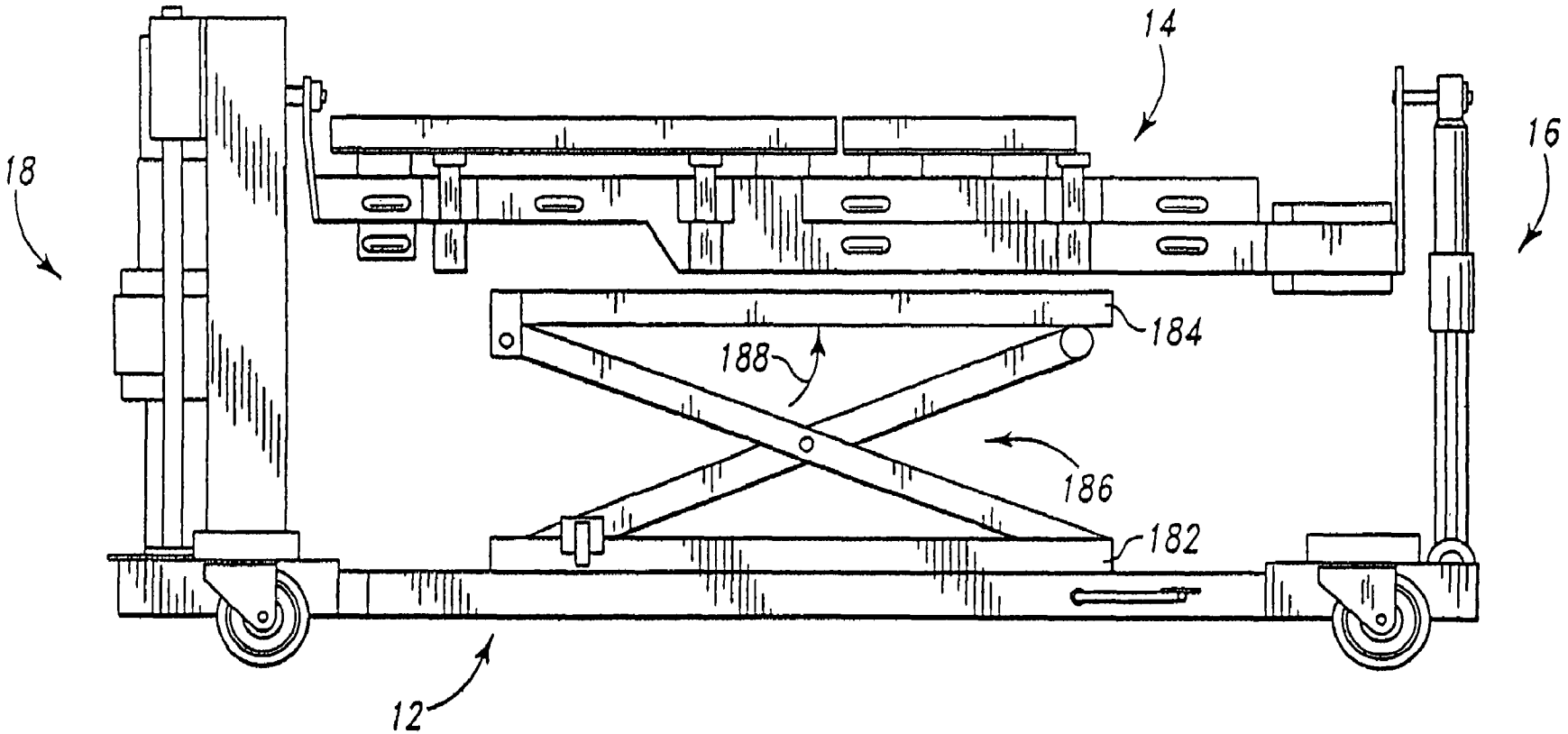
FIG. 5 is a side elevational view similar to FIG. 3 illustrating a transfer surface moved to an elevated position.

In the illustrated embodiment, a movable transfer surface 180 is coupled to base 12. Illustratively, transfer surface includes a bottom portion 182, a top portion 184, and a lifting mechanism 186 as best shown in FIG. 5. A suitable actuator such as a cylinder or gear mechanism is used to move the lifting mechanism from a lowered position shown in FIGS. 1–4 to an elevated position shown in FIG. 5. It is understood that any suitable lifting mechanism may be used to raise and lower the top portion 184 relative to the frame assembly 14. Actuation of the lifting mechanism causes continued movement of the top surface in the direction of arrow 188 in FIG. 5. When it is desired to load or remove the patient support surface 162 on to the bed, the transfer surface 180 is actuated to move the top portion 184 upwardly to a location generally the same height as the first and second side frame members 80 and 82. Top surface 184 is capable of supporting the patient support surface 162 and the patient if support surface 162 is not properly engaged with the latch mechanisms 160.

Details of the latch mechanisms 160 are illustrated in FIGS. 6–9. Each latch mechanism 160 includes a housing 192 having a first latch member 194 movably coupled to the housing 192 by a pin 196 movable in an elongated slot 198 of housing 192. A spring 200 is configured to bias the first latch member 194 in the direction of arrow 195 to an extended position shown in FIGS. 7–9. A shaft 204 and a handle 206 are coupled to the first latch member 194 to permit a caregiver to move the first latch member 194 to a retracted position shown in FIG. 6.

Figure 16:
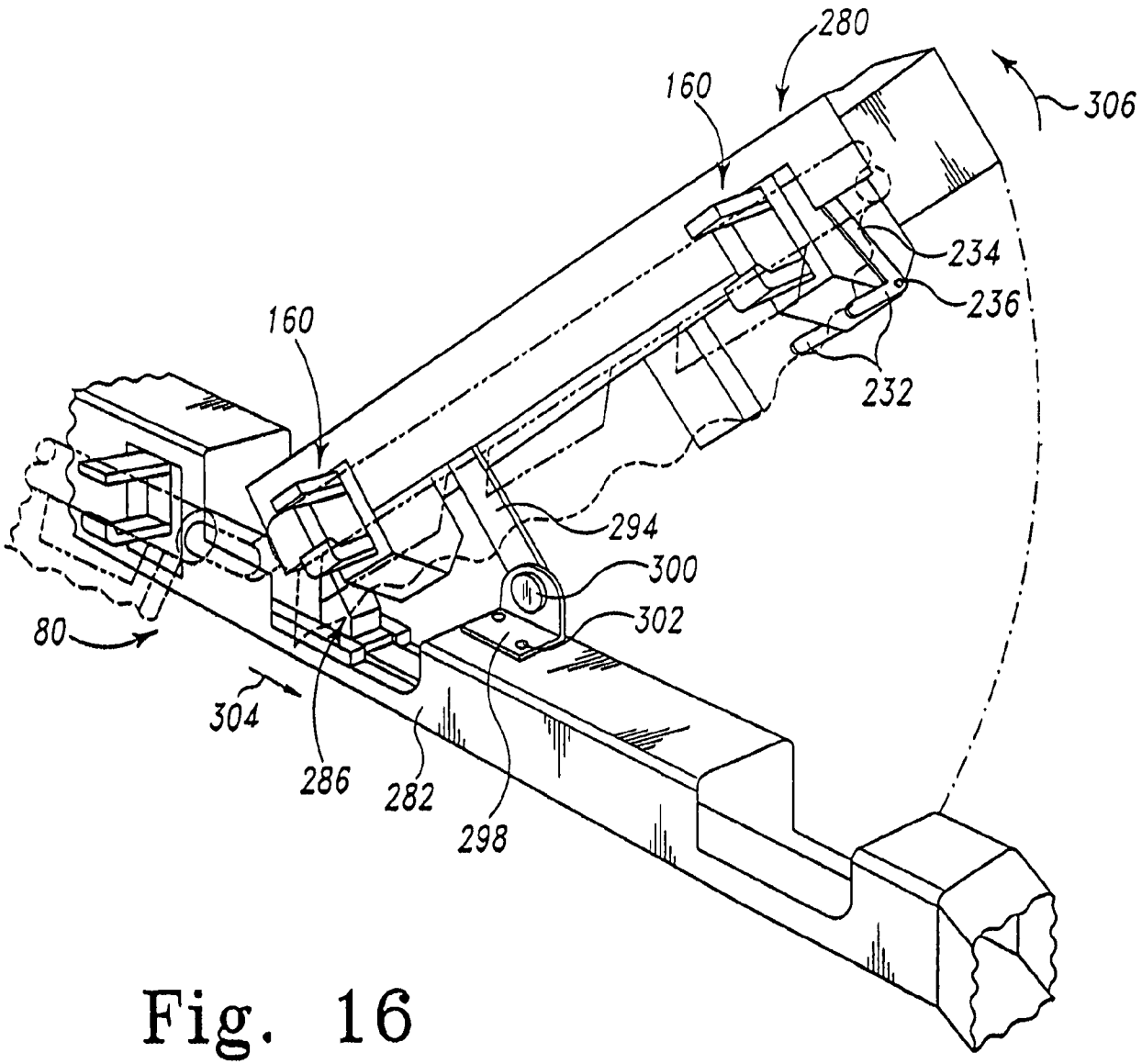
FIG. 16 is a perspective view further illustrating the first side frame member with the movable portion in the elevated position of FIG. 15.

When it is desired to load patient support surface 162 on to the bed 10, a caregiver operates controls to raise the top surface 184 of the transfer surface 180 upwardly in the direction of arrow 188 of FIG. 5. An actuator 230 includes a first arm portion 232 and a second arm portion 234. Actuator 230 is pivotably coupled to housing 192 by a pin 236. Actuator 230 includes a slot 238 which fits over pin 196. Illustratively, first and second actuators 230 are located on opposite sides of each latch mechanism 160 as best shown in FIG. 16. In FIG. 16, the actuators 230 are shown only on one latching mechanism 160. It is understood that such actuators 230 may be included on all the latch mechanisms 160.

Figure 6:
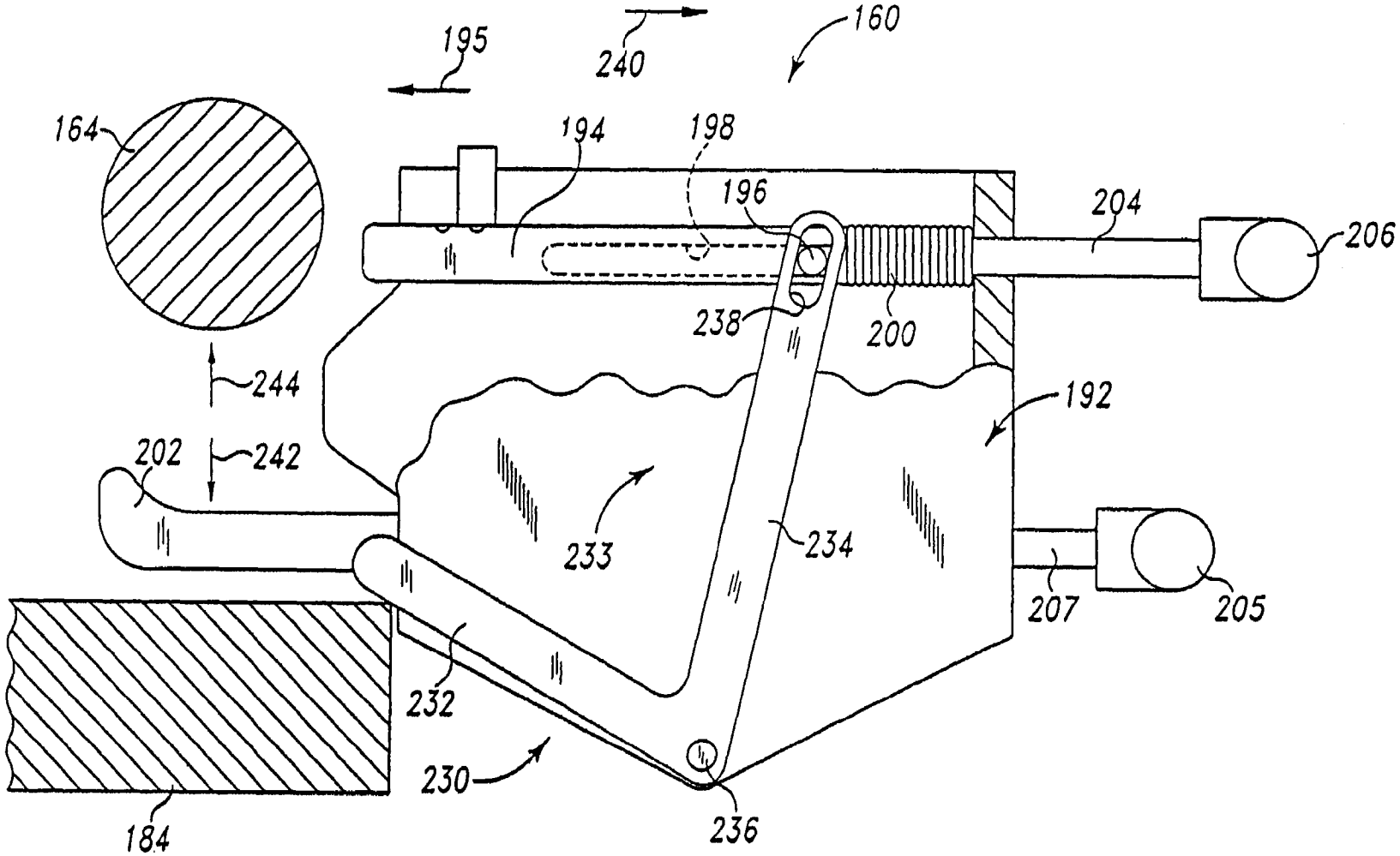
FIG. 6 is a partial sectional view taken through a latch mechanism on the first side frame member which is configured to receive an outer frame of the patient support surface, and illustrating the transfer surface engaging an actuator on the latch mechanism to open a first latch member and permit the patient support surface to be loaded into or removed from the latch mechanism.
Figure 7:
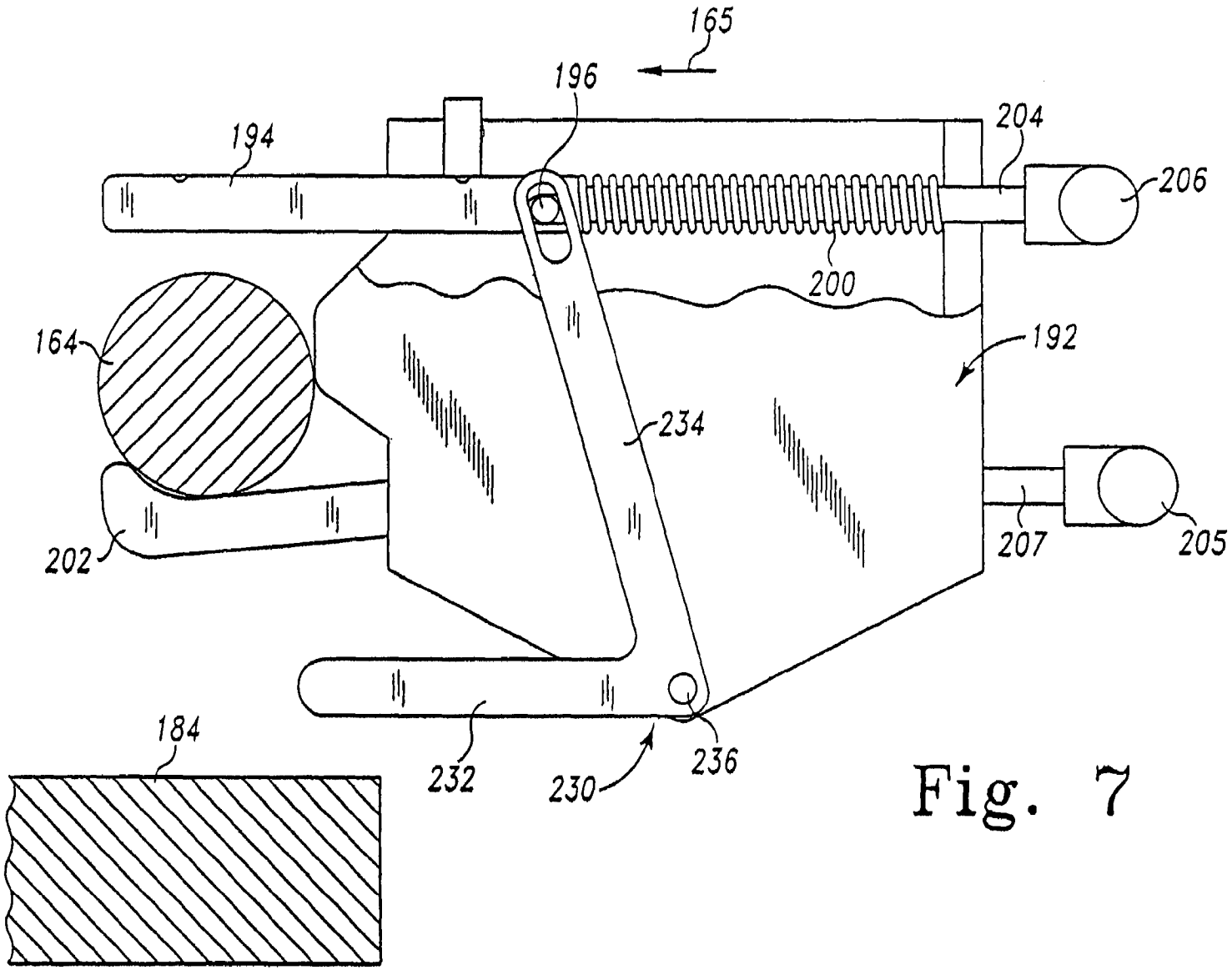
FIG. 7 is a sectional view similar to FIG. 6 illustrating the outer frame of the patient support surface engaging a second latch member and illustrating the first latch member located over the outer frame member to retain the outer frame of the patient support surface within the latch mechanism.
Figure 8:
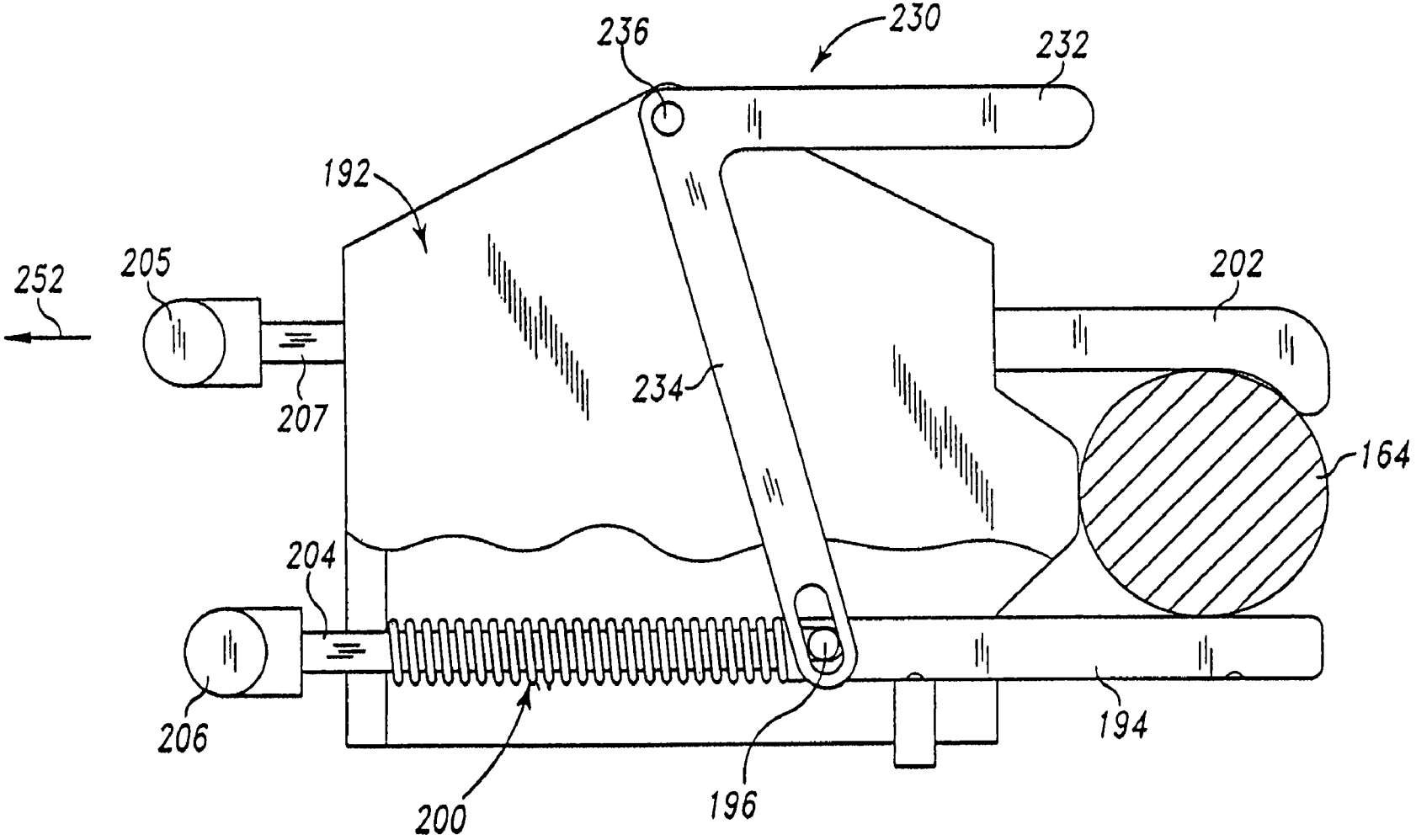
FIG. 8 is a sectional view illustrating the latch mechanism of FIGS. 6 and 7 after the first and second side frame members have been rotated 180° to prone a patient.

When the transfer surface 184 engages arm 232 of actuator 230, the actuator 230 pivots in the direction of arrow 233 to the position shown in FIG. 6. Pivotable movement of actuator 230 moves pin 196 in the direction of arrow 240 to move the first latch member 194 to its retracted position. This permits the patient support surface 164 to be loaded into the latch mechanism 160 as illustrated in FIG. 6. Illustratively, the outer frame 164 of patient support surface 162 moves downwardly in the direction of arrow 242 to load the patient support surface 162 into the latch mechanisms 160. A second latch member 202 is also located within housing 192 spaced apart from first latch member 194. Illustratively, second latch member 202 is also spring biased to an extended position as shown in FIGS. 6–8. Frame 164 is supported by second latch member 202 as shown in FIG. 7.

The transfer surface 184 is then moved downwardly which permits the spring 224 to move the first latch member 194 to the extended position shown in FIG. 7. Therefore, the patient support surface 162 is secured to the first and second side frame members 80 and then 82. When it is desired to move the patient support surface 162, the transfer surface 184 is again raised to engage the actuators 230 and retract the first latch member 194. The outer frame 164 may then be lifted upwardly out of the latch mechanism 160 in the direction of arrow 244 in FIG. 6.

Figure 9:
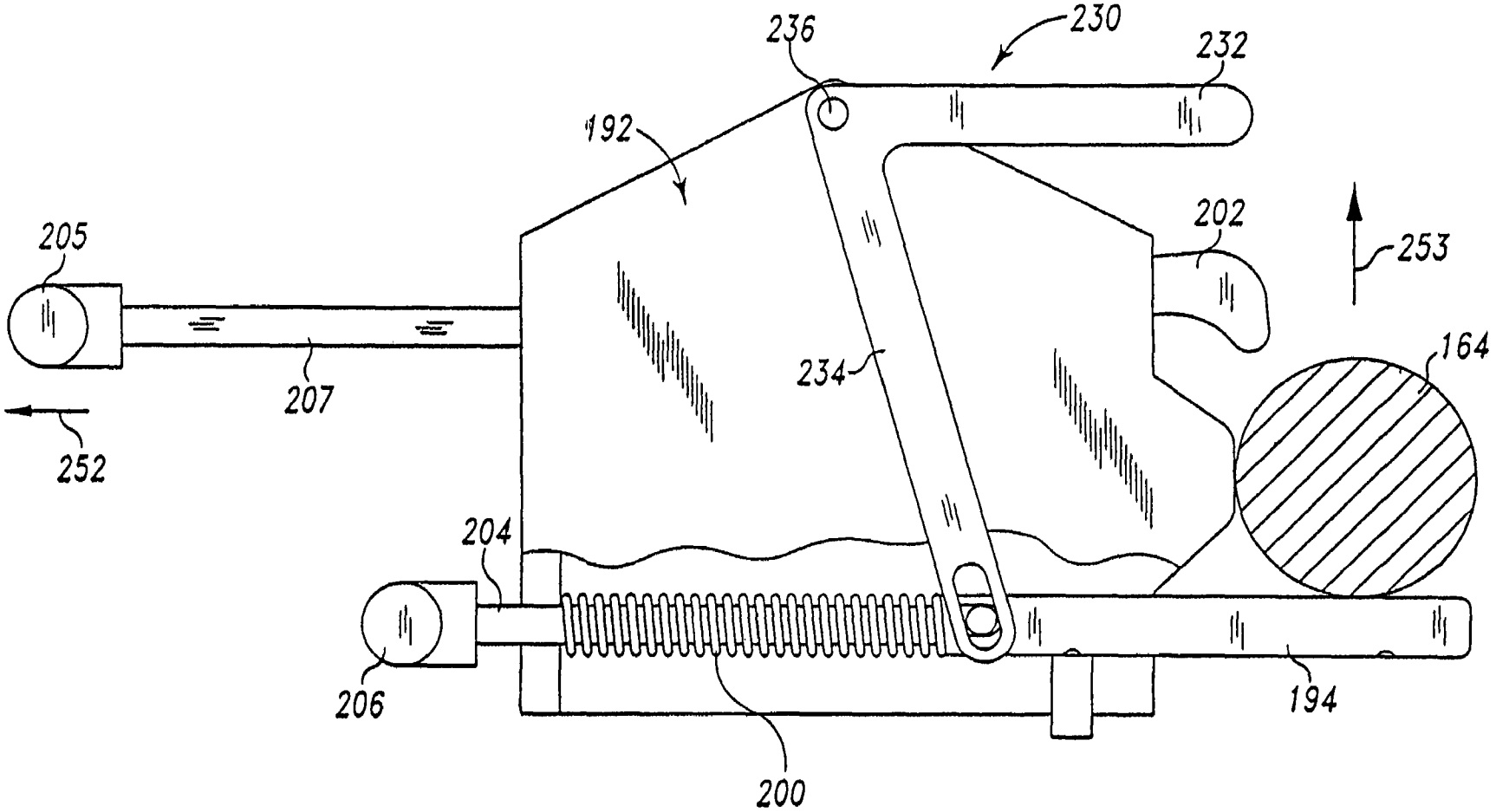
FIG. 9 is a sectional view similar to FIG. 8 in which the second latch member has been retracted manually to permit removal of the patient support surface when the first and second side frame members are in the prone position.

FIGS. 8 and 9 illustrate latch mechanism 160 when the first and second side frame members 80 and 82 are moved or rotated to the prone position shown in FIG. 23. When in the prone position as discussed in detail below, it is often desirable to remove the patient support surface 162 to permit access to the patient located on the proning surface 250. In order to release the patient support surface 162 when the latch mechanism 160 is in the prone position, actuator handle 205 coupled to shaft 207 is pulled in the direction of arrow 252 shown in FIGS. 8 and 9 which moves the second latch member 202 to the retracted position of FIG. 9. The patient support surface 162 can then be removed in the direction of arrow 253.

Figure 11:
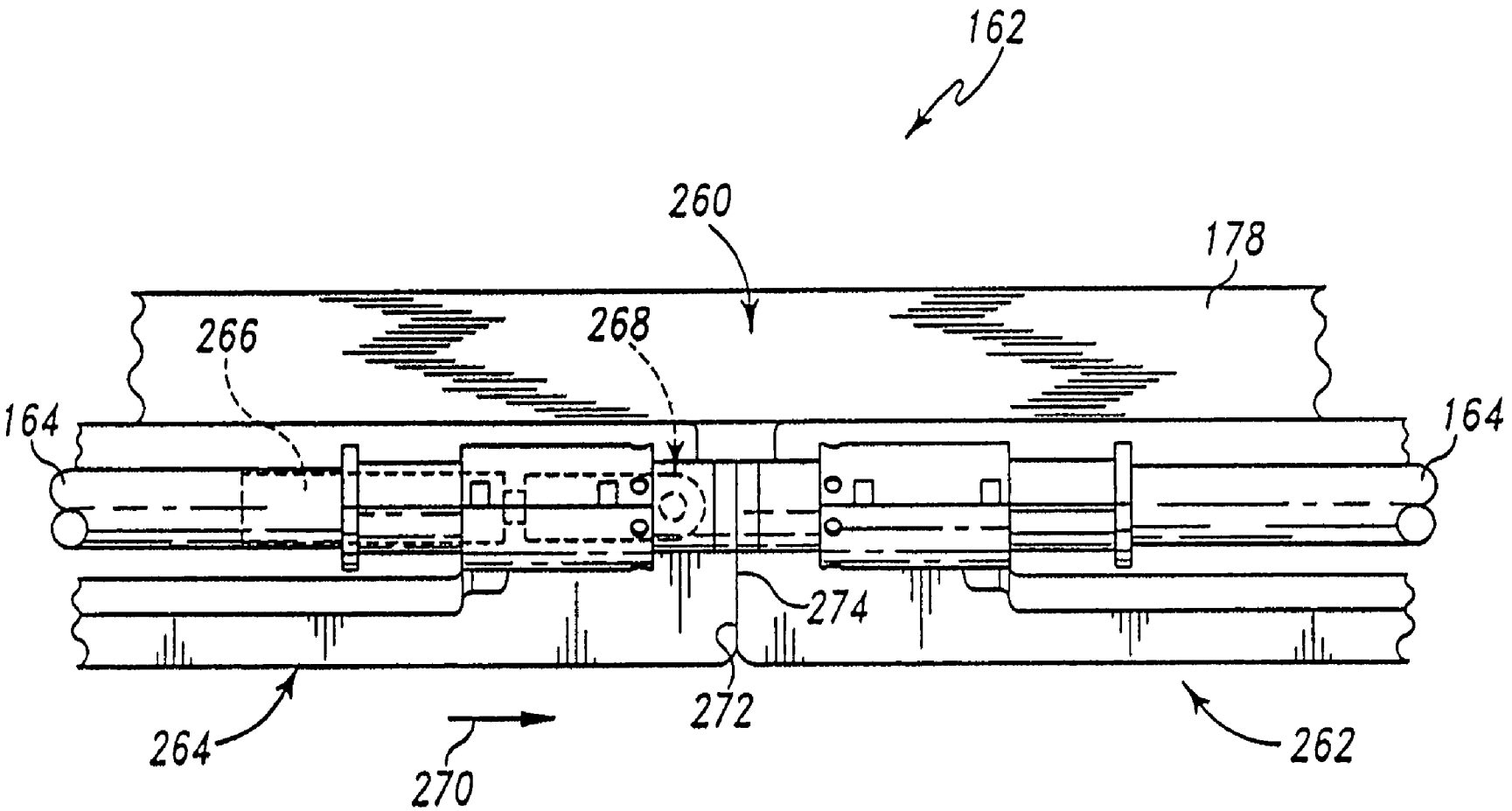
FIG. 11 is a partial side elevational view illustrating a joint connection between a back section of the patient support surface and a seat section of the patient support surface.
Figure 12:
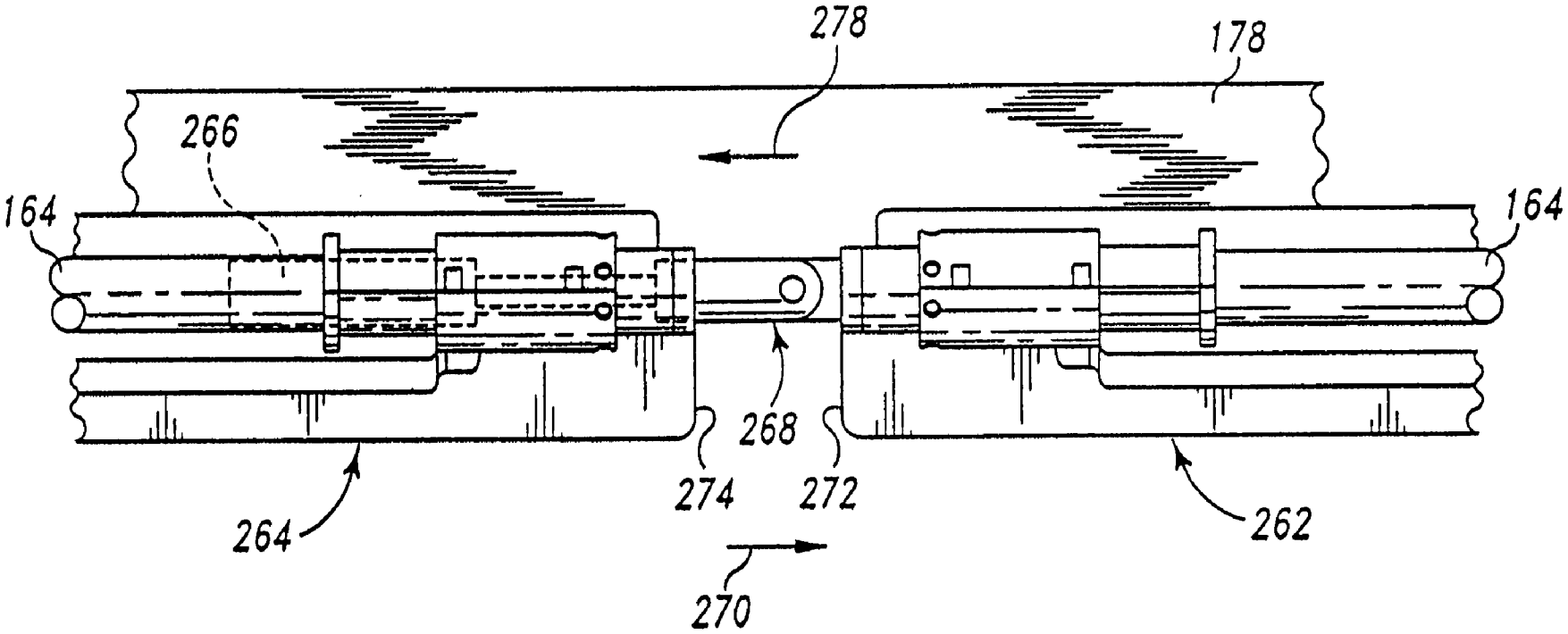
FIG. 12 is a view similar to FIG. 11 illustrating extension of the joint connection to permit pivotable movement of the back section of the patient support surface relative to the seat section of the patient support surface.
Figure 13:
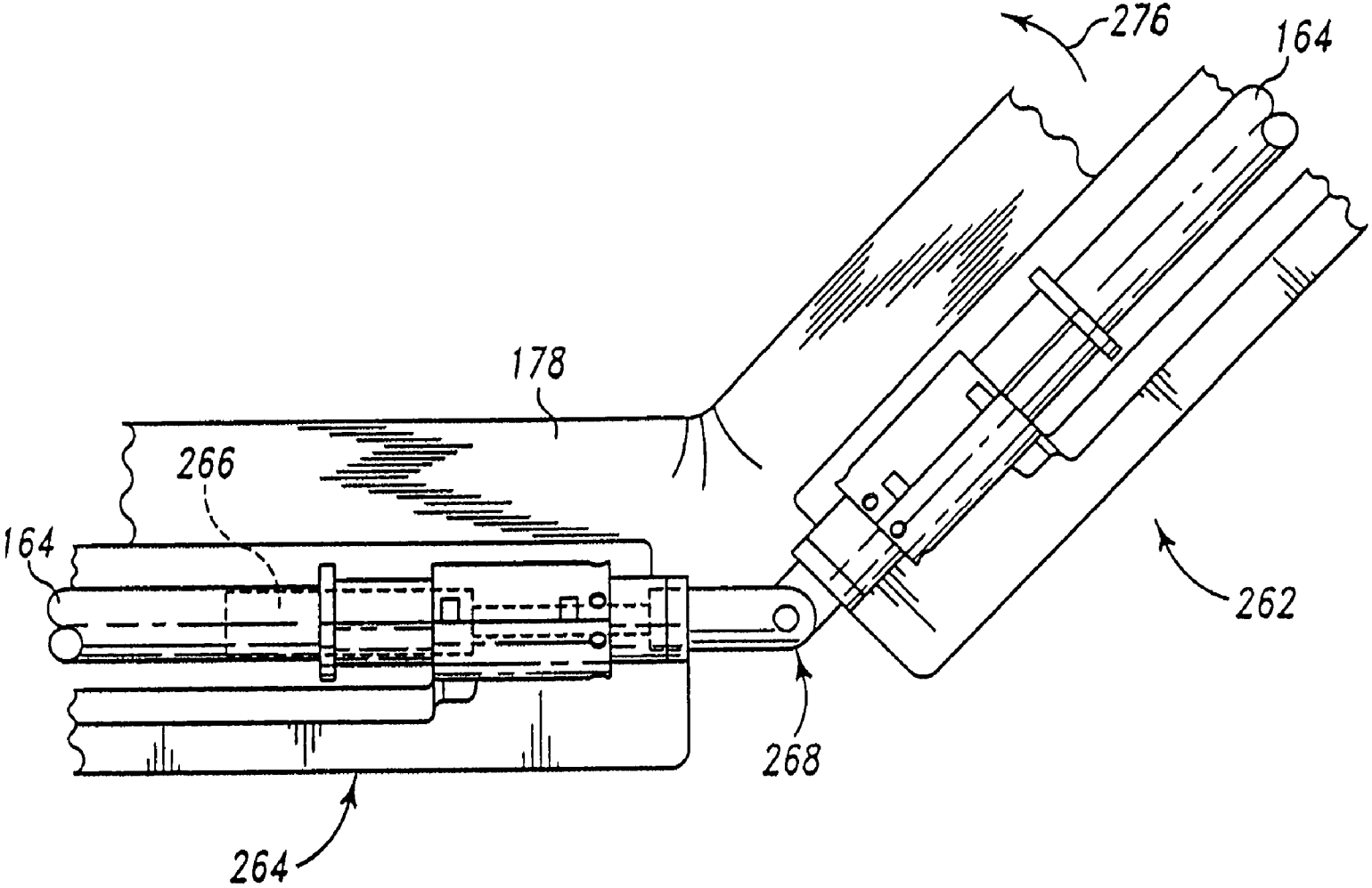
FIG. 13 is a partial side view similar to FIGS. 11 and 12 illustrating the back section of the patient support surface moved to an elevated position to raise the head of the patient.

FIGS. 11–13 illustrate a pivotable back section of the patient support surface 162. Outer frame 164 includes a joint connection 260 which couples a back section 262 and a seat section 264 together. FIGS. 11–13 also illustrate the mattress 178 on the patient support surface 162. When it is desired to move the back section 262 relative to the seat section 264, an actuator 266 located within the outer frame 264 is actuated to permit extension of a pivot joint 268 in the direction of arrow 270 of FIG. 11. When the pivot joint 268 is in the retracted position shown in FIG. 11, the joint 268 is located within a cylinder of the outer frame member of seat section 264 so that the joint 268 cannot pivot. Therefore, back section 262 and seat section 264 are locked in the planar configuration shown in FIG. 1 for transport of the patient. An end 272 of back section 262 illustratively abuts an end 274 of seat section 264 when the joint 268 is in the retracted position.

It is understood that although one pivot connection 268 and actuator 266 are shown in FIG. 11, such pivot joints 268 and actuators 266 are located on both sides of the patient support surface 162. Illustratively, actuator 266 is a cylinder, gear, solenoid, or other type of actuator which permits movement of the pivot joint 268 to the extended position shown in FIG. 12. The entire back section 262 moves in the direction of arrow 270 along with the pivot joints 268. Once the pivot joint 268 moves to the extended exposed position, back section 262 is pivotable upwardly relative to seat section 264 as illustrated by arrow 276 in FIG. 13. Therefore, the patient's head can be raised to an elevated position when the pivot joints 268 are moved to the extended position. Movement of the back section toward the head end of the patient support surface 162 as the back section is elevated provides a shearless pivot mechanism for the patient support surface 162. When the back section 262 returns to the flat position of FIG. 12, the actuator 266 is again actuated to permit the pivot joints 268 to move in the direction of arrow 278 back to the retracted and locked position shown in FIG. 11.

Figure 14:
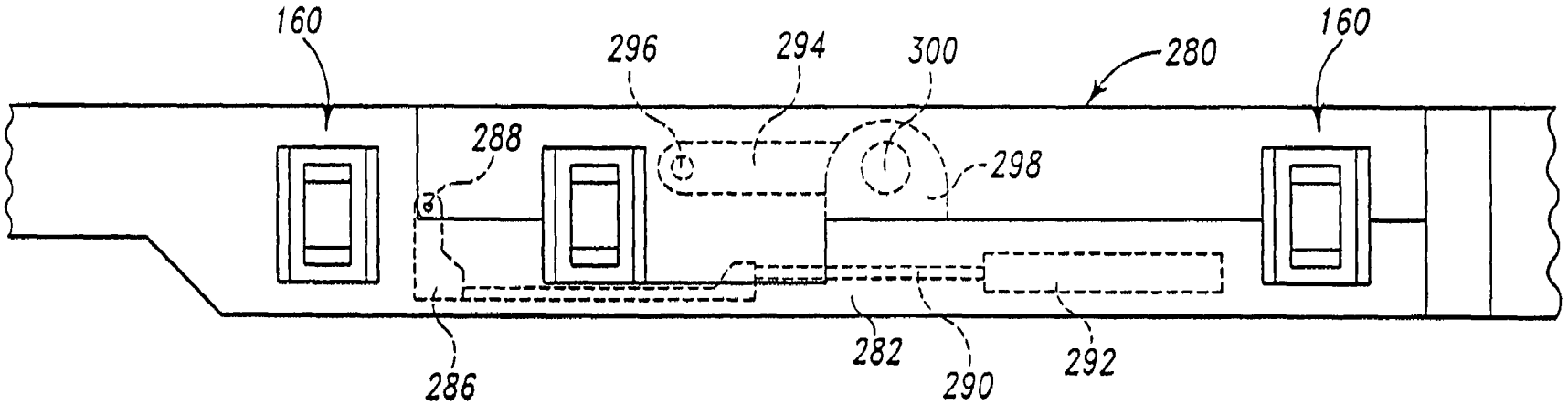
FIG. 14 is a partial side elevational view of the first side frame member including a fixed frame portion and a movable back section which moves toward a head end of the bed as it is pivoted upwardly.
Figure 15:
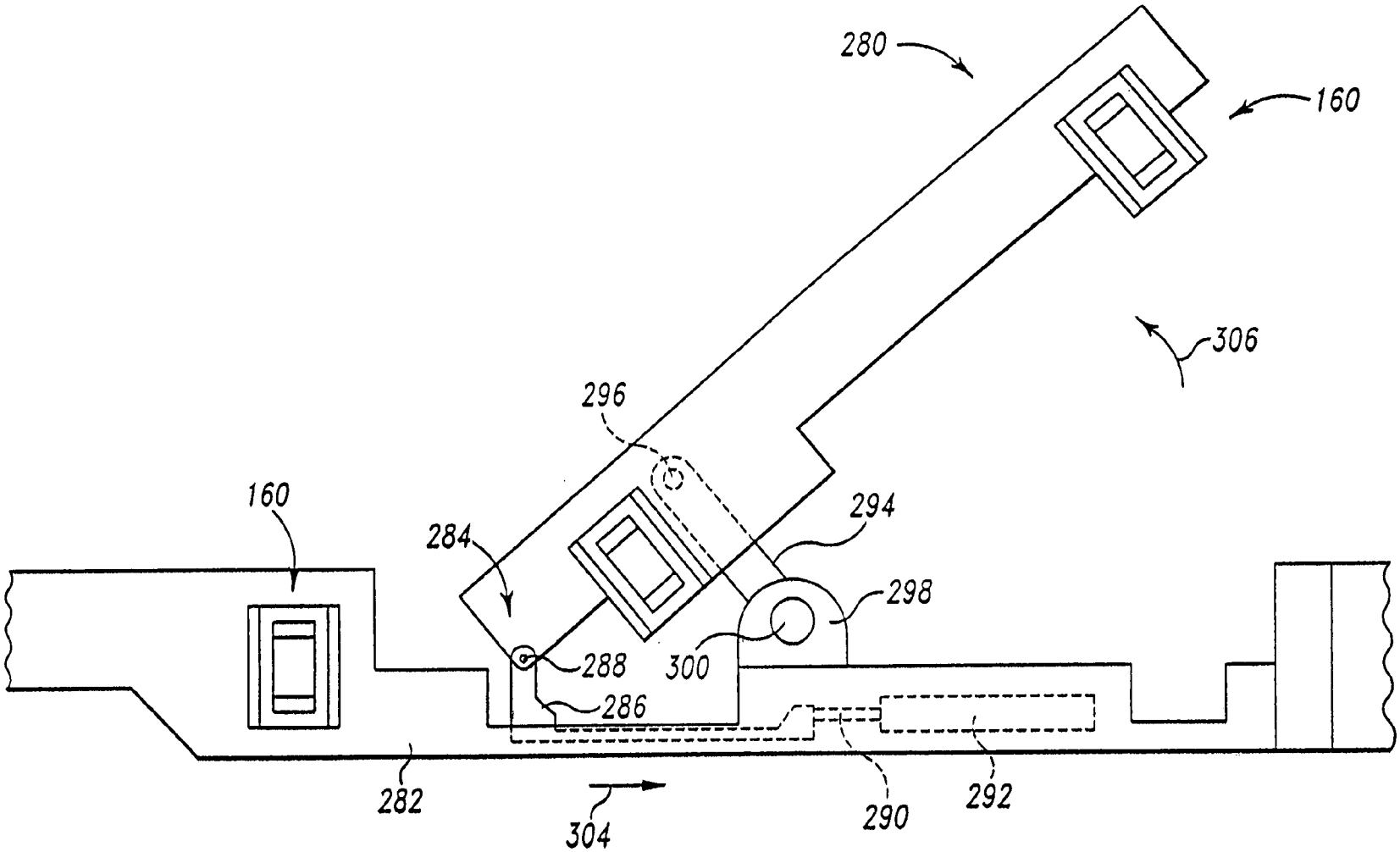
FIG. 15 is a view similar to FIG. 14 in which the movable portion of the frame member has been moved to its elevated position and toward the head end of the bed.

First and second side frame members 80 and 82 include movable back support sections 280 as best shown in FIGS. 14–16. Movable back sections 280 provide a shearless pivot head elevation mechanism for bed 10. Movable back sections 280 are coupled to fixed frame portions 282. As best shown in FIGS. 14 and 15, a first end portion 284 of movable back section 280 is pivotably coupled to a movable support member 286 by a pivot connection 288. An opposite end of support 286 is illustratively coupled to a piston 290 of a cylinder 292 to move the support 286 relative to the fixed frame portion 282. It is understood that other types of actuators may be used in place of cylinder 292 including gears, pulleys, or other drive mechanisms.

Movable back section 280 is also pivotably coupled to a link arm 294 by pivot connection 296. An opposite end of link arm 294 is pivotably coupled to one end of a mounting plate 298 by pivot connection 300. Plate 298 is coupled to fixed frame member 282 by suitable fasteners 302 as shown in FIG. 16. Therefore, when cylinder 292 is actuated to retract piston 290, support 286 moves in the direction of arrow 304 to the position shown in FIGS. 15 and 16. Link arm 294 causes the back support 280 to pivot upwardly to the elevated position in the direction of arrows 306 as the support moves in the direction of arrow 304. Since the back section 280 moves toward the head end of the bed 10 as it is elevated, the lifting mechanism provides a shearless pivot mechanism for the back section 280.

Connections between the patient support surface 162 and the side frame member 80 are illustrated by the dotted lines in FIG. 16. When the back section 280 begins movement to the elevated position, the actuator 266 within the patient support surface 162 is actuated to permit the pivot joints 268 to move to the position of FIGS. 12 and 13 so that the back section 262 of the patient support surface 162 is capable of movement to the elevated position.

Figure 17:
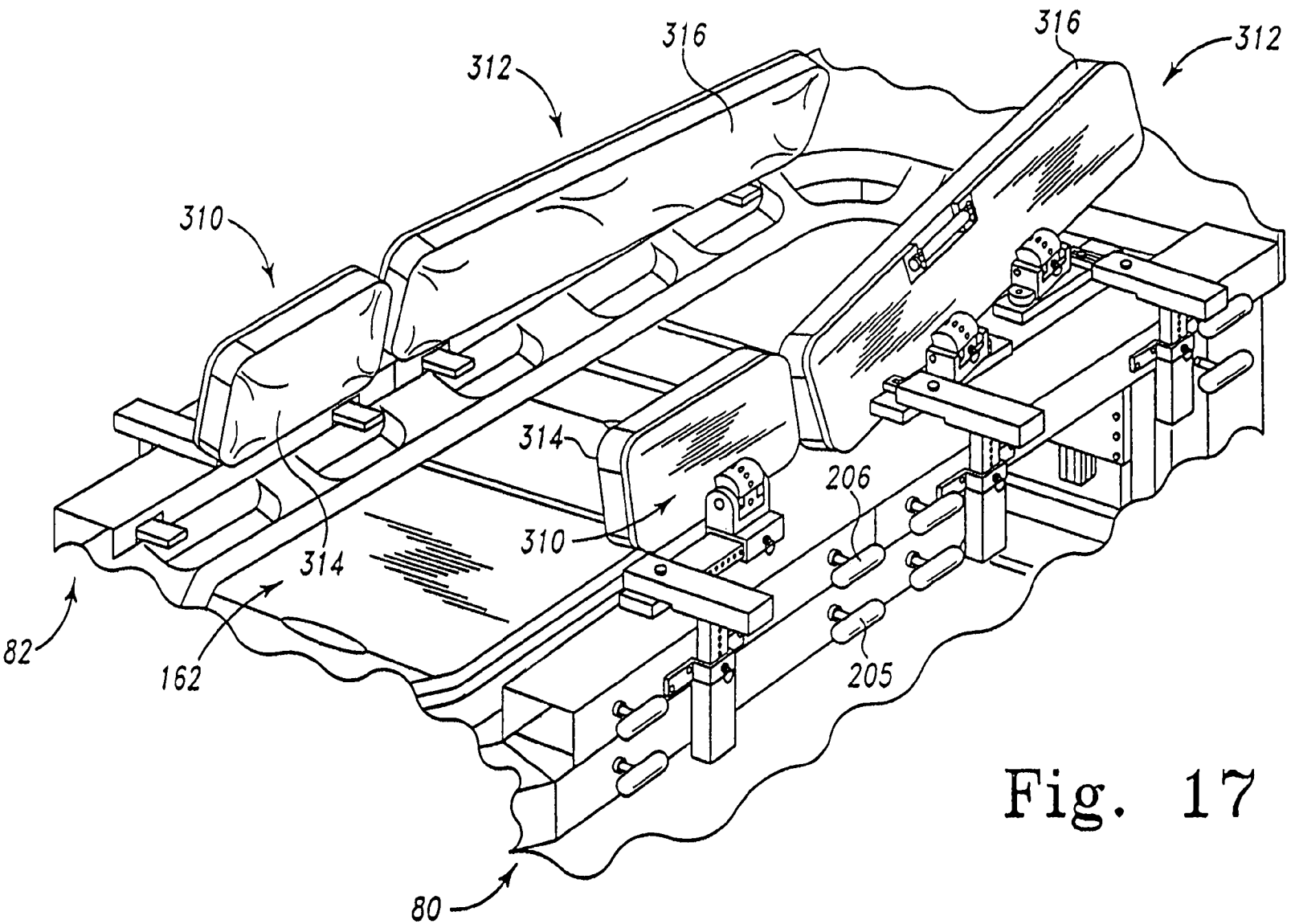
FIG. 17 is a perspective view illustrating first and second side support members coupled to each of the first and second side frame members, the side support members being movable from a first position in which the first and second side supports form a part of the patient support surface to other positions in which the side supports are pivoted upwardly and moved toward the patient to provide side supports which may be necessary, for instance, during rotation therapy of the patient located on the patient support surface.

The bed 10 of the present invention further includes side supports 310 and 312 coupled to each of the first and second side frame members 80 and 82. The side supports 310 and 312 are movable to a first position shown in FIGS. 1–5 in which top support surfaces 314 and 316 are located over the first and second side frame members generally parallel to mattress 178 to form a portion of the surface for supporting the patient. In other words, the top surfaces 314 and 316 cooperate with the mattress 178 to provide a patient support surface. Supports 310 and 312 are movable relative to the side frame members 80 and 82 as best illustrated in FIGS. 17–19 to provide supports for opposite sides of the patient located on the patient support surface 162.

Figure 18:
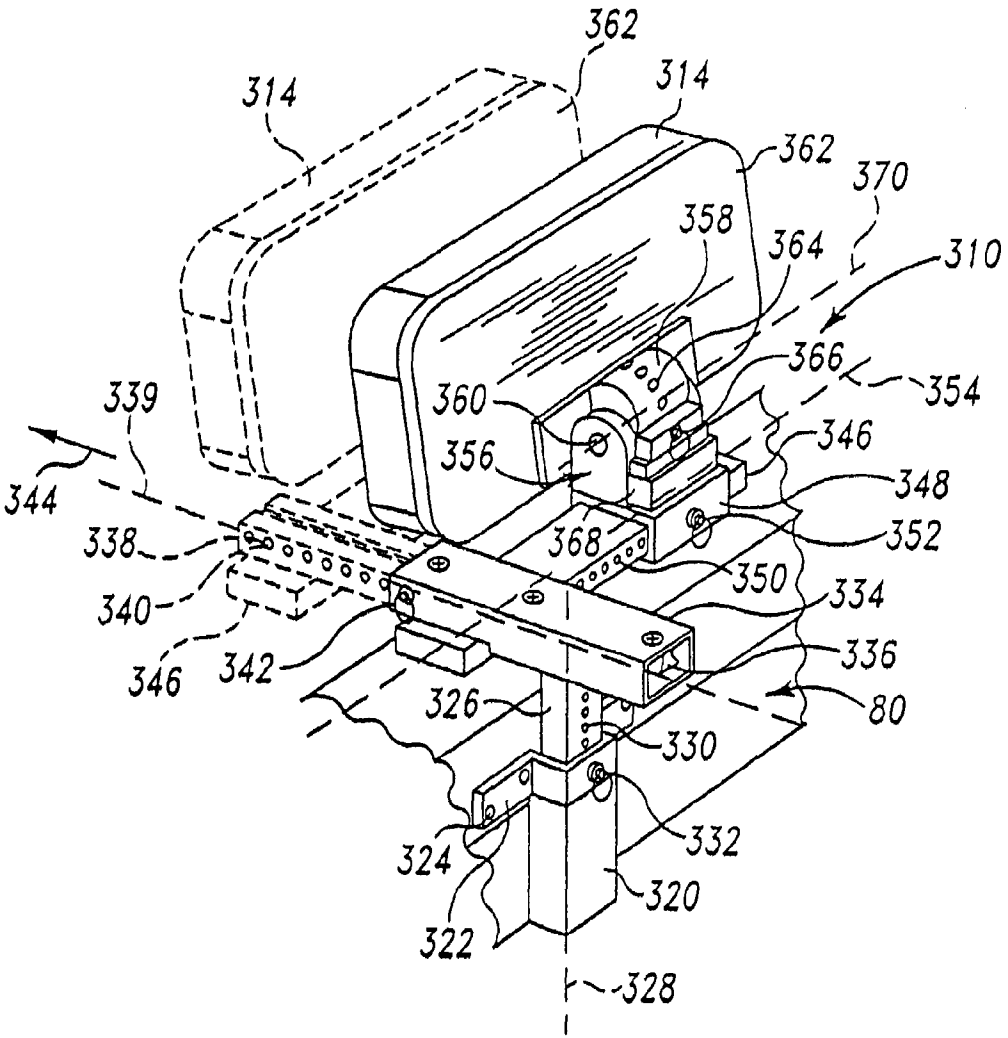
FIG. 18 is an enlarged view illustrating details of the first side support member of FIG. 17.
Figure 19:
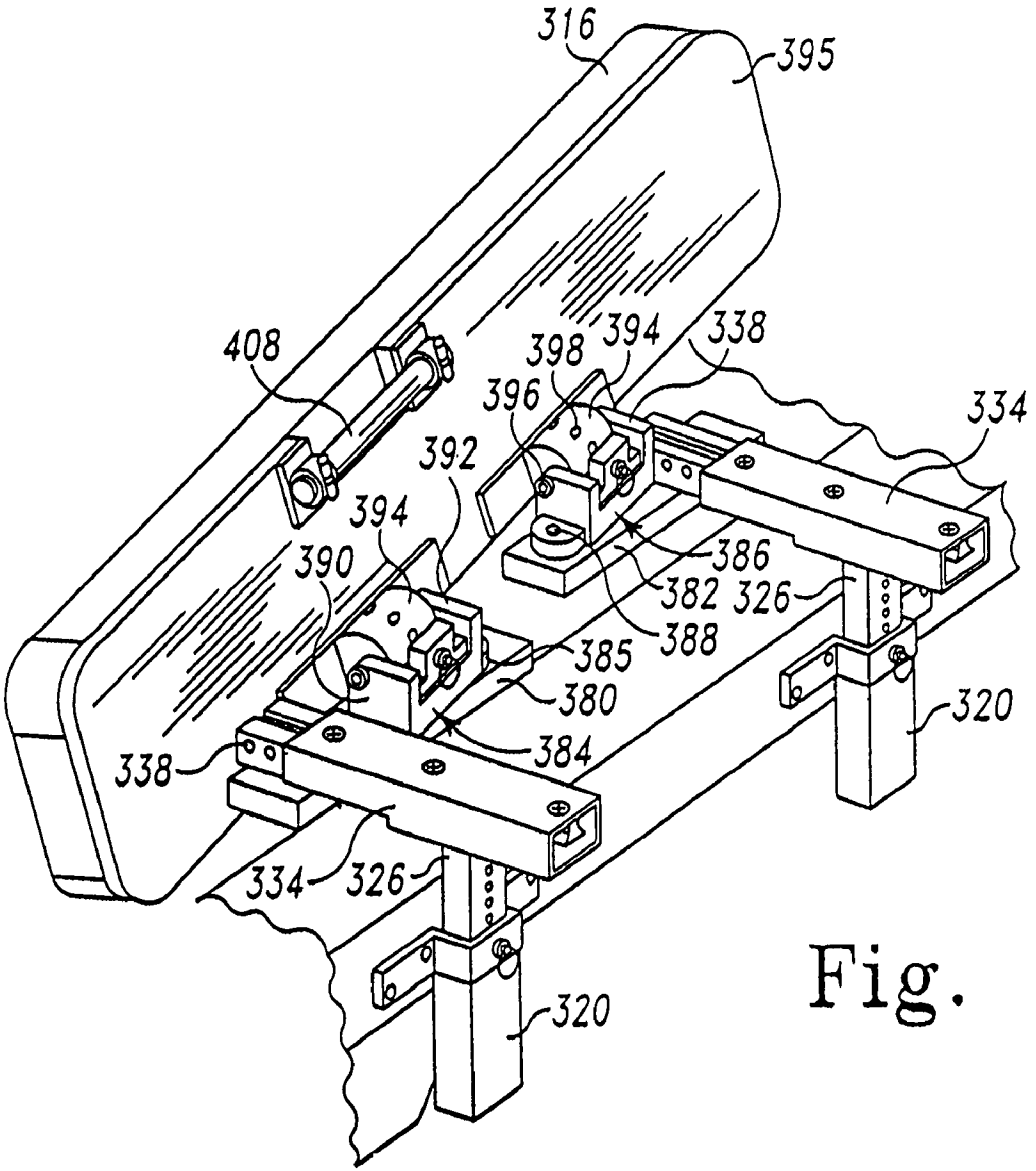
FIG. 19 is an enlarged view illustrating details of the second side support member of FIG. 17.

Details of movable side support 310 are shown in FIG. 18. A channel 320 is illustratively coupled to side frame member 80 by a bracket 322 and suitable fasteners 324. It is understood that any suitable channel may be provided which is either coupled to or formed integrally with the side frame member 80 for supporting the side support 310. A block 326 is slidably received within channel 320. Block 326 is movable up and down relative to channel 320 along axis 328. Illustratively, block 328 includes a plurality of apertures 330 which are engaged by a pin 332 to hold the block 326 in a desired position. It is understood that any type of locking mechanism may be used to hold the block 326 in position relative to channel 320.

Block 326 is also coupled to another channel 334. Channel 334 includes an internal track 336 and a slidable block 338 located within the channel 334. Block 338 is movable relative to channel 336 from a retracted position shown by solid lines in FIG. 18 to an extended position shown by dotted lines in FIG. 18 along axis 339. Block 338 is illustratively formed to include a plurality of apertures 340 which are engaged by a pin 342 on channel 334 to lock the block 338 in a desired position. Movement of block 338 relative to channel 334 permits the support surface 314 to be moved inwardly in the direction of arrow 344 toward a patient on the patient support surface 162.

Another block 346 is rigidly coupled to block 338. A sleeve 348 is configured to surround block 346. Block 346 includes a plurality of apertures 350. A pin 352 is coupled to sleeve 348. Pin 352 is configured to engage a selected aperture 350 to hold the sleeve in a desired position relative to block 346. Therefore, sleeve 348 can move on block 346 along axis 354 to a desired location.

A clevis 356 is mounted on sleeve 348. A cylinder 358 is pivotably coupled to clevis 356 by pin 360. Cylinder 358 is rigidly coupled to a base plate 362 which holds the support surface 314. Cylinder 358 illustratively includes a plurality of apertures 364 configured to be engaged by a pin 366 which is coupled to a block 368 located on sleeve 348. Therefore, base plate 362 and cylinder 358 are rotatable about axis 370 to a desired angular location and then held in the selected position by pin 366. Adjustable side support 310 configured to be adjusted in a plurality of different directions so that the location of the support surface 314 can be positioned at the desired height and angle relative to the patient. The support 314 is movable inwardly toward the patient and also toward the head or foot of the patient on the patient support surface 162.

Side support 312 is further illustrated in FIG. 19. Side support 312 is coupled to the side frame member 80 by two spaced apart coupling mechanisms similar to the coupling mechanisms discussed above with reference to FIG. 18. Those elements referenced by numbers identical to FIG. 18 perform the same or similar function. Blocks 330 are movable upwardly and downwardly relative to channels 320. Blocks 340 are movable out of channels 334 to move the support surface 316 inwardly toward the patient. In the embodiment of FIG. 19, blocks 380 and 382 are rigidly coupled opposite blocks 338. A first pivotable support 384 is coupled to block 380 by pivot connection 385. A second support 386 is coupled to block 382 by pivot connection 388. Each of the supports 384 and 386 include spaced apart walls 390 and 392. Cylindrical portions 394 are pivotably coupled between walls 390 and 392 by pins 396. Cylindrical portions 394 are formed to include a plurality of apertures 398 configured to be engaged by pins 400 on support blocks 384 and 386 to lock the cylindrical portions 394 in a desired orientation. Cylindrical portions 394 are rigidly coupled to base plate 395 which holds support surface 316. A handle 400 facilitates adjustment of the side support. Since the support blocks 384 and 386 are pivotable on blocks 380 and 382, one end of side support 312 can be extended further inwardly toward the patient as illustrated in FIGS. 17 and 19.

Side supports 310 and 312 are typically used to help stabilize the patient on the patient support surface 162 during rotational therapy of the patient on the patient support surface 162. During rotational therapy, the patient is rotated side to side at angles of up to 30°–40° at selected rotation rates. Therefore, side supports 310 and 312 provide support against sides of the patient during the rotational therapy. In addition, when it is desired to prone the patient, the side supports 310 and 312 are moved to the upwardly pivoted positions to provide supports along opposite sides of the proning surface 250. When not in use, the side supports 310 and 312 are moved back to the storage position shown in FIGS. 1 and 2 in which the support surfaces 314 and 316 of side supports 310 and 312, respectively, cooperate with mattress 178 to provide a portion of the patient support surface.

Figure 20:
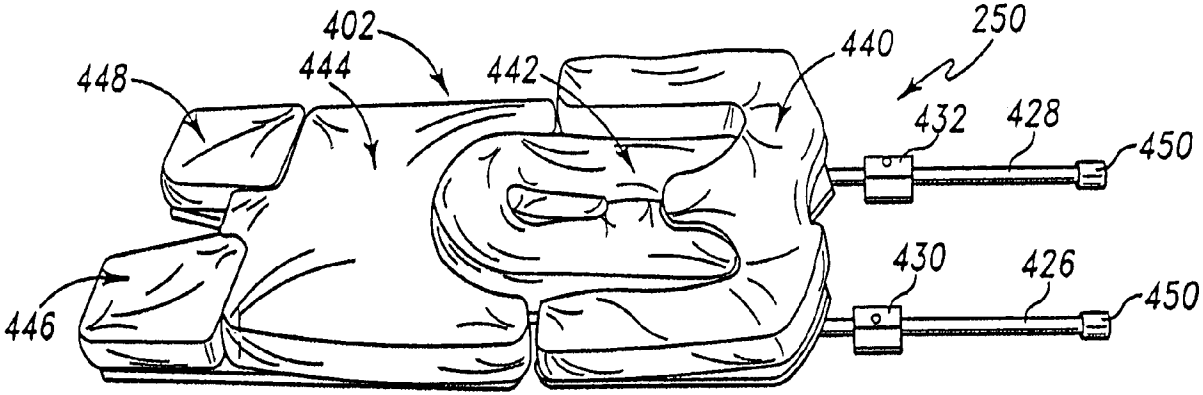
FIG. 20 is a perspective view illustrating one embodiment of a proning surface of the present invention which includes structural support components and surface components configured to engage the front portion of the patient's body to provide support for the patient in a prone position.
Figure 21:
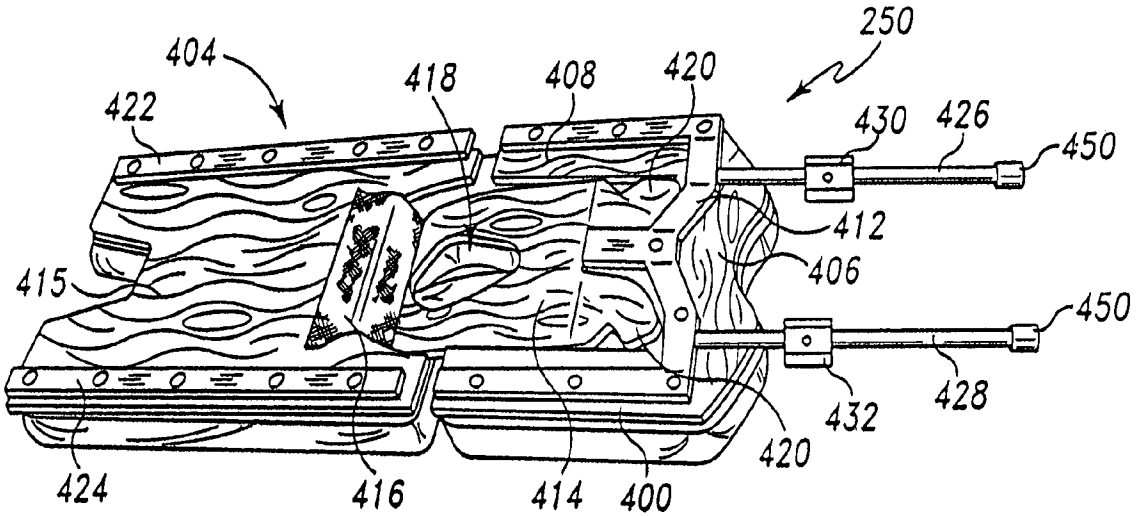
FIG. 21 is a perspective view of the proning surface of FIG. 20 illustrating the opposite side of the proning surface including structural components to provide support for the patient in the prone position.

One embodiment of the proning surface is illustrated in FIGS. 20–23. Proning surface 250 includes a patient engaging surface 402 best illustrated in FIG. 20 and structural support components 404 best shown in FIGS. 21 and 22. Structural support components include a chest support surface 406 having opposite side portions 408 and 410. In the illustrated embodiment, a metal frame member 412 is coupled to chest support surface 406 for additional support. A central support portion 414 is coupled to a lower body support portion 415 by a flexible material 416. Central support portion 414 includes an aperture 418 located adjacent a patient's abdomen area. End portions 420 of central support portion 414 are coupled to chest support section 408 by flexible material (not shown). Illustratively, first and second metal support plates 422 and 424 are coupled to opposite sides of section 415. Sections 408, 414 and 415 are illustratively formed from wood, metal, fiberglass, or molded plastic material. First and second rods 426 and 428 are coupled to frame member 412. Brackets 430 and 432 are located on rods 426 and 428, respectively. Brackets 430 and 432 are used to couple to a face support 434 to the rods 426 and 428 as best shown in FIGS. 22 and 23. Face support 434 is illustratively coupled to brackets 430 and 432 by connectors 436 and 438, respectively. FIG. 20 illustrates separate support surface sections 440, 442, 444, 446, and 448 which are coupled to opposite sides of structural supports 406, 414, and 415. Supports 440, 442, 444, 446, and 448 are illustratively made from any suitable material such as foam, air, gel, fluid, beads, or other pressure reducing material.

When it is desired to rotate a patient on the patient support surface 162 to a prone position, the prone surface 250 is coupled to the head and foot end plates 74 and 90 as best shown in FIGS. 22 and 23. Illustratively, end portions 450 of rods 426 and 428 are coupled to head end plate 74 by suitable fasteners (not shown). Brackets 430 and 432 are movable on rods 426 and 428, respectively, to adjust the position of face plate 434 on the patient 452. An opposite end of proning surface 250 is secured to foot end plate by connecting arms 454 and 456. Arms 454 and 456 are pivotably coupled to section 415 of proning surface 250 by pivot connections 458 and 460, respectively. Opposite ends of arms 454 and 456 are coupled to plate 90 by a suitable fastener 462.

It is understood that any type of suitable fasteners may be used to couple the proning surface 250 to the bed. For instance, straps, belts, cylinders, or brackets may be used to couple the proning surface 250 to the head end plate 74, the foot end plate 90, or the first and second side frame members 80 and 82. As it is best shown in FIG. 22, a head side support 470 and shoulder support 472 are pivotably coupled to each of the side frame members 80 and 82. In the illustrated embodiment, side head support 470 is pivotably coupled to an arm 474. Arm 474 is pivotably coupled to bracket 476 which is pivotably connected to another bracket 478. Shoulder support 472 is pivotably coupled to an arm 480. An opposite end of arm 480 is pivotably coupled to bracket 476. Head support 470 and shoulder support 472 are pivotable relative to side frame members 80 and 82 so that these supports can be moved to a storage position adjacent the side frame members 80 and 82 when not in use.

FIG. 23 illustrates the position of the bed when rotational drive mechanism 130 is actuated to rotate the frame assembly 14 to prone the patient. For clarity, the patient is not shown in FIG. 23. In addition, the side supports 310 and 312 are shown in the stored position. Typically, when a patient is on the prone surface 250, the side supports 310 and 312 are in the upwardly pivoted position shown in FIGS. 17–19 to provide support along opposite sides of the patient on the proning surface 250. Once the patient is in the prone position as shown in FIG. 23, the patient support surface 162 may be removed as discussed above to provide access to a back side of the patient.

Figure 24:
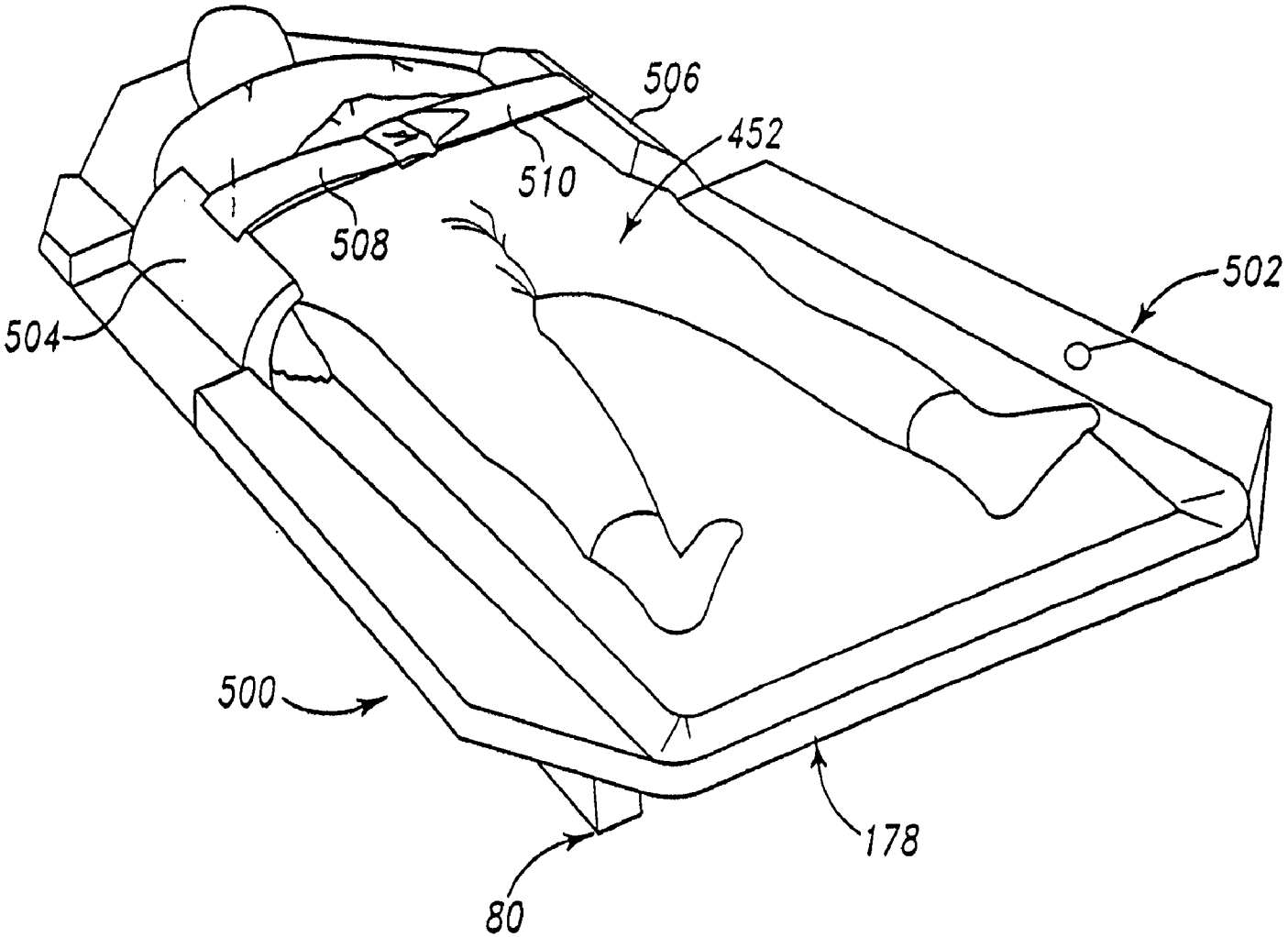
FIG. 24 is a perspective view of another embodiment of the present invention illustrating portions of a support surface on first and second side frame members which pivot upwardly to provide side supports for the patient during rotational therapy.
Figure 26:
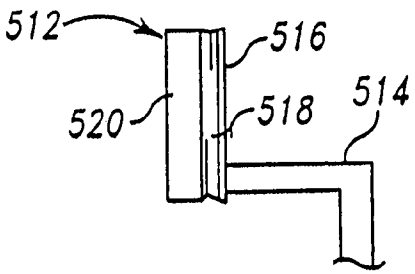
FIG. 26 is a side elevational view of one of the side supports of FIG. 25.
Figure 27:
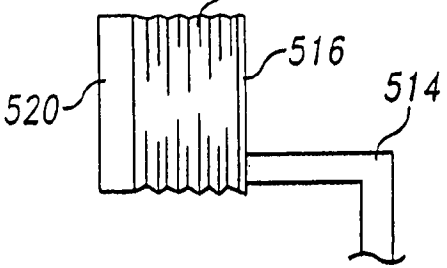
FIG. 27 is a side elevational view similar to FIG. 26 in which a patient engaging surface of the side support has been extended by a bellows mechanism.

FIGS. 24–30 illustrate additional side supports of the present invention. In FIG. 24, side support surfaces 500 and 502 are located over first and second side frame members 80 and 82, respectively. Surface portions 500 and 502 therefore cooperate with mattress 178 to provide a patient support surface for patient 452. Sections 504 and 506 of supports 500 and 502, respectively, are pivotable upwardly to the position shown in FIG. 24. Straps 508 and 510 are coupled together to hold the surface sections 504 and 506 against opposite sides of the patient 452 to provide support for rotational therapy on the patient.

Figure 25:
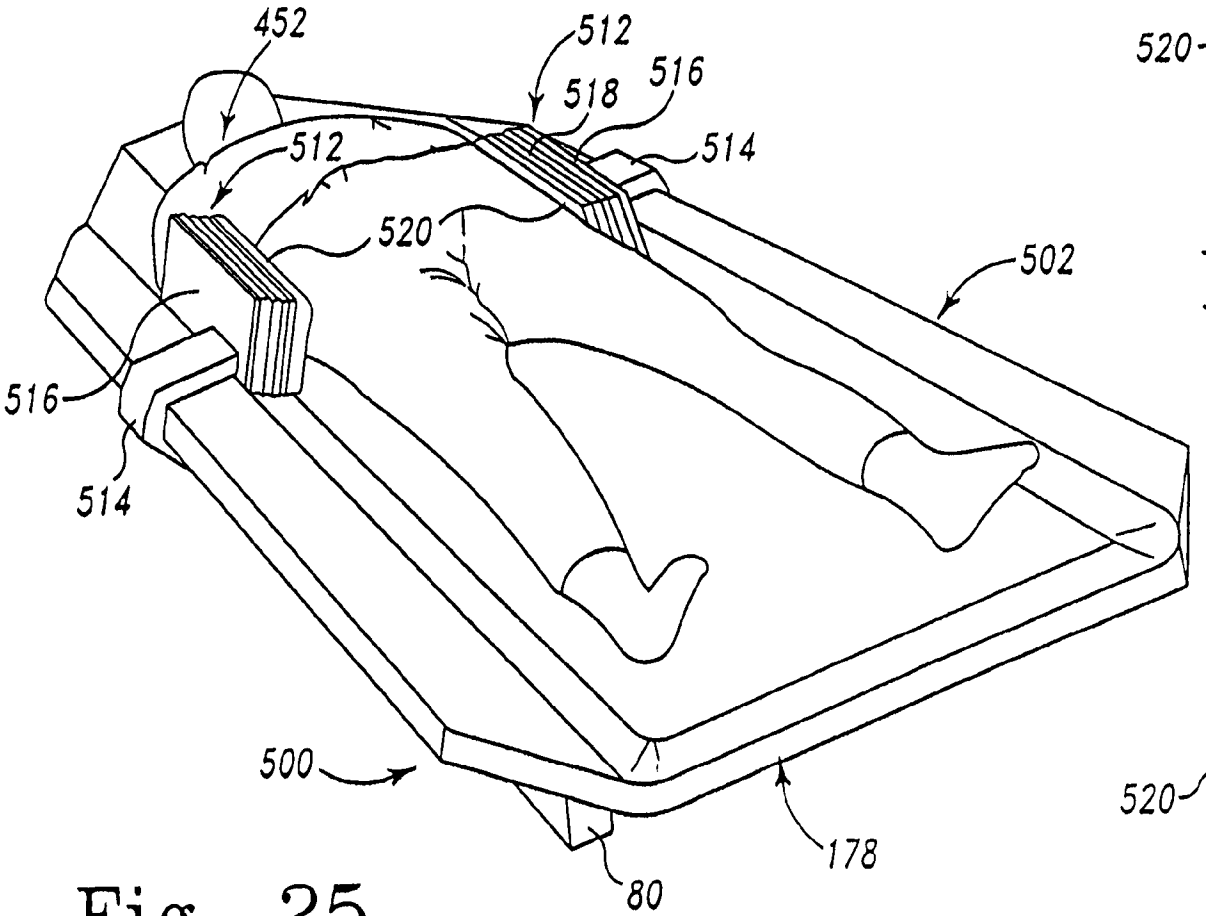
FIG. 25 is a perspective view illustrating another embodiment of side supports of the present invention.

Another embodiment of the side supports is illustrated in FIG. 25. In this embodiment, side supports 512 are mounted on both first and second side frame members 80 and 82 by a suitable coupling mechanisms 514. Coupling mechanism 514 may be similar to the coupling mechanisms discussed above or is any suitable type of coupling mechanism. Side supports 512 include a base plate 516, a bellows 518, and a patient engaging surface 520. Illustratively, air is supplied to the bellows chamber 518 to move the patient engaging surface 520 inwardly toward the patient in the direction of arrow 522 in FIG. 27 so that the patient engaging surfaces 520 engage opposite sides of the patient 452. It is understood that a single inflatable bladder may be used in place of bellows 518 and surface 520 on base plate 516.

Figure 29:
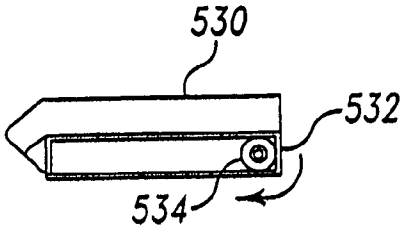
FIG. 29 is a sectional view taken through one of the side supports of FIG. 28 illustrating a side support bladder in a retracted position.
Figure 30:
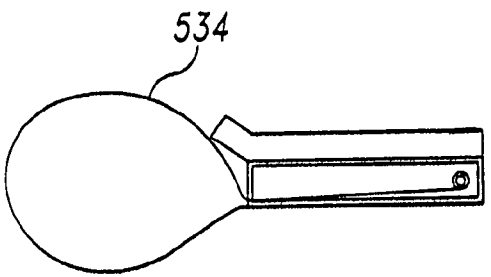
FIG. 30 is a section view similar to FIG. 29 illustrating a side support bladder in an inflated position to provide support against a side of the patient.
Figure 28:
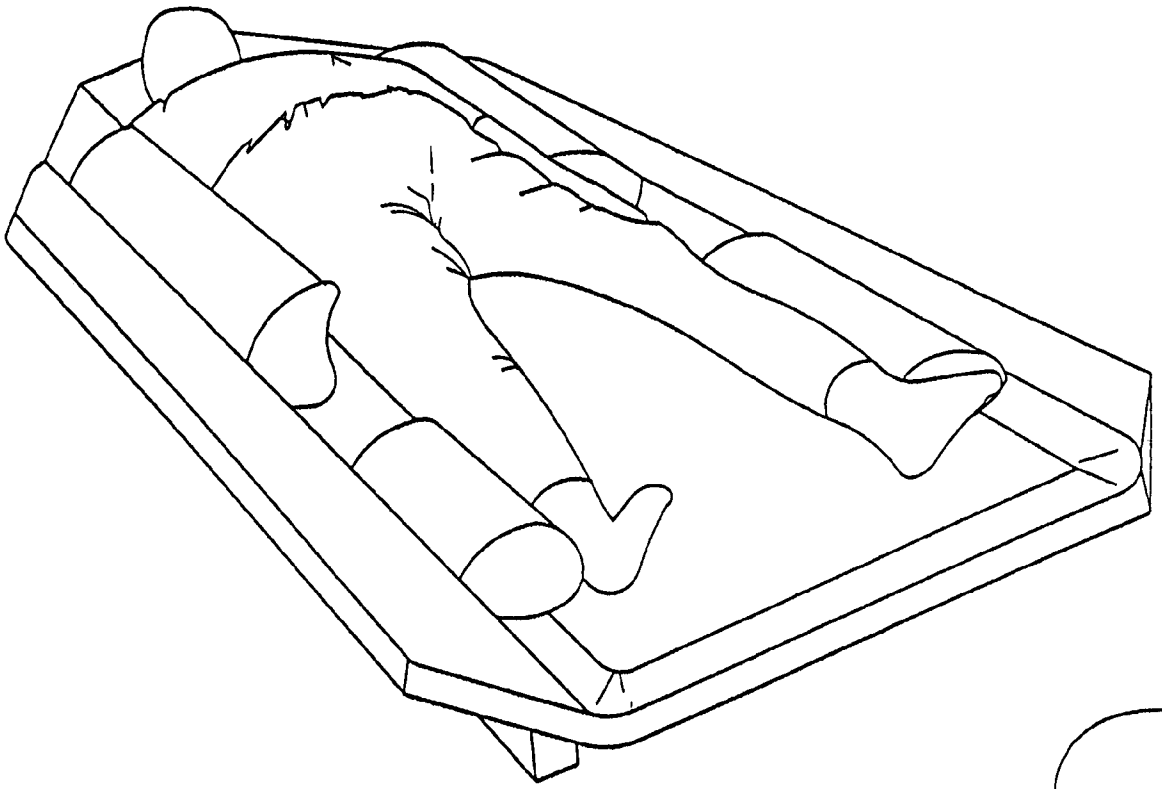
FIG. 28 is a perspective view of another embodiment of side supports of the present invention.

Another embodiment of the present invention is illustrated in FIGS. 28–30. In this embodiment, portions of the side supports 500 and 502 include a top support surface 530 and a lower housing 532 which contains an inflatable bladder 534. Air is supplied to the inflatable bladder 534 so that the bladder 534 moves out of the housing 532 as shown in FIGS. 28 and 30 to engage a side of the patient 452 to provide support for rotational therapy. Illustratively, a vacuum pulls bladders 534 back into the housing 532.

The inflatable air bladders located adjacent opposite sides of the patient are illustratively connected to an air supply which delivers air pressure in pulses, such as sinusoidal or square-wave pulses to the bladders. Pulses of air pressure are illustratively sent at a range of 0–25 Hz and compress the sides of the patient to provide percussion/vibration therapy. Such inflatable air bladders may be provided in any of the patient engaging side surfaces of any of the side supports disclosed herein. These devices therefore supply percussion/vibration therapy to the sides or chest of the patient instead of the back of the patient as in prior percussion/vibration therapy devices.

Although the invention has been described in detail with reference to certain illustrated embodiments, variations and modifications exist within the scope and spirit of the invention as described and defined in the following claims.

The invention claimed is:

1. A bed comprising:

a base;

a frame coupled to the base, the frame including a top surface and a bottom surface;

a patient support surface coupled to the frame;

a support assembly coupled to the base and the frame, the support assembly including a drive mechanism coupled to the frame which is configured to rotate the frame about a longitudinal axis to move the patient support surface from a supine position to a prone position;

a proning surface configured to be coupled to the frame to support a patient in the prone position; and a side support coupled to the frame and including a patient engaging surface and a coupling mechanism for attaching the patient engaging surface to the frame, the coupling mechanism being configured to permit movement of the patient engaging surface along an axis transverse to a longitudinal axis of the bed to abut a side of a patient on the patient support surface.

2. The bed of claim 1, wherein the coupling mechanism is further configured to permit vertical adjustment of the patient engaging surface.

3. The bed of claim 2, wherein the coupling mechanism is further configured to permit movement of the patient engaging surface along an axis parallel to the longitudinal axis.

4. The bed of claim 3, wherein the coupling mechanism includes:

a first channel coupled to the frame;

a first block slidably received within the first channel and supported for vertical movement;

a second channel coupled to the first block;

a second block slidably received within the second channel and supported for movement along an axis transverse to the longitudinal axis;

a third block coupled to the second block; and a sleeve supported for movement relative to the third block along an axis parallel to the longitudinal axis.

5. The bed of claim 4, wherein the coupling mechanism further includes a clevis coupled to the sleeve, and a cylinder pivotably coupled to the clevis and supporting the patient engaging surface.

6. The bed of claim 1, wherein the patient engaging surface is pivotable relative to the coupling mechanism about an axis parallel to the longitudinal axis.

7. The bed of claim 1, further comprising a locking mechanism configured to hold the patient engaging surface in a desired location.

8. The bed of claim 1, wherein the bed includes a head end and an opposing foot end, the side support being positioned adjacent one of the head end and the foot end.

9. The bed of claim 1, wherein the drive mechanism is configured to rotate the frame at least 180 degrees about the longitudinal axis.

10. A bed comprising:

a base;

a frame coupled to the base;

a patient support surface coupled to the frame;

a drive mechanism coupled to the frame which is configured to rotate the frame about a longitudinal axis to move the patient support surface from a supine position to a prone position; and a side support coupled to the frame and including a patient engaging surface and a coupling mechanism for attaching the patient engaging surface to the frame, the coupling mechanism being configured to provide at least four degrees of freedom for movement of the patient engaging surface, including a first degree of freedom permitting movement of the patient engaging surface along an axis transverse to a longitudinal axis of the bed to abut a side of a patient on the patient support surface, a second degree of freedom permitting movement of the patient engaging surface along a vertical axis, a third degree of freedom permitting movement of the patient engaging surface along an axis parallel to the longitudinal axis of the bed, and a fourth degree of freedom permitting rotational movement of the patient engaging surface along an axis parallel to the longitudinal axis of the bed.

11. The bed of claim 10, further comprising a locking mechanism configured to restrict the number of degrees of freedom.

12. A bed comprising:

a base;

a frame supported by the base;

a patient support surface removably coupled to and supported by the frame; and a side support supported by the frame and independent of the patient support, the side support including a patient engaging surface and a coupling mechanism for supporting the patient engaging surface, the coupling mechanism being configured to permit movement of the patient engaging surface along an axis transverse to a longitudinal axis of the bed to abut a side of a patient on the patient support surface, the coupling mechanism being further configured to permit movement of the patient engaging surface along a vertical axis.

13. The bed of claim 12, further comprising a support assembly including a drive mechanism coupled to the frame which is configured to rotate the frame about a longitudinal axis to move the patient support surface from a supine position to a prone position.

14. The bed of claim 12, the coupling mechanism being further configured to permit movement of the patient engaging surface along an axis parallel to the longitudinal axis of the bed.

15. The bed of claim 12, wherein the patient engaging surface is pivotable relative to the coupling mechanism about an axis parallel to the longitudinal axis of the bed.

16. The bed of claim 12, further comprising a locking mechanism configured to hold the patient engaging surface in a desired location.

17. The bed of claim 12, wherein the bed includes a head end and an opposing foot end, the side support being positioned adjacent one of the head end and the foot end.

18. The bed of claim 12, wherein the coupling mechanism includes a channel supported by the frame and a member slidably received within the channel and supported for vertical movement.

19. The bed of claim 18, wherein the coupling mechanism further includes a track and a block supported for sliding movement along an axis transverse to a longitudinal axis of the bed.

20. The bed of claim 12, further comprising a locking mechanism configured to hold the patient engaging surface in a desired location.

21. A bed comprising:

a base;

a frame supported by the base;

a patient support surface supported by the frame;

a support assembly including a drive mechanism coupled to the frame which is configured to rotate the frame about a longitudinal axis to move the patient support surface from a supine position to a prone position; and a side support supported by the frame, the side support including a patient engaging surface, a coupling mechanism for supporting the patient engaging surface, and an inflatable bladder coupled to the patient engaging surface and configured to move the patient engaging surface inwardly along an axis transverse to a longitudinal axis of the bed to abut a side of a patient.

22. The bed of claim 21, wherein the inflatable bladder comprises an expandable bellows.

23. A bed comprising:

a base;

a frame supported by the base;

a patient support surface supported by the frame; and a side support supported by the frame, the side support including a patient engaging surface, a coupling mechanism for supporting the patient engaging surface, and an inflatable bladder coupled to the patient engaging surface and configured to move the patient engaging surface inwardly alone an axis transverse to a longitudinal axis of the bed to abut a side of a patient, wherein the inflatable bladder is supplied with pulses of air pressure to compress the side of a patient and provide percussion/vibration therapy.

24. The bed of claim 23, wherein the pulses of air pressure are sent at a range of between 0 and 25 Hertz.

25. A bed comprising:

a base;

a frame supported by the base;

a patient support surface supported by the frame; and a side support supported by the frame, the side support including a top surface, a lower housing coupled to the top surface, an inflatable bladder received within the lower housing and supporting a patient engaging surface, wherein air supplied to the bladder causes the patient engaging surface to move out of the lower housing and inwardly along an axis transverse to a longitudinal axis of the bed to abut a side of a patient.

26. The bed of claim 25, further comprising a support assembly including a drive mechanism coupled to the frame which is configured to rotate the frame about a longitudinal axis to move the patient support surface from a supine position to a prone position.

27. The bed of claim 25, wherein the air bladder is coupled to an air supply which delivers air pressure in pulses.

28. The bed of claim 27, wherein a vacuum pulls the inflatable bladder back into the lower housing.

29. The bed of claim 25, wherein the pulses of air pressure are sent at a range of between 0 and 25 Hertz.

* * * * *